US010065770B2

(12) United States Patent
Howell et al.

(10) Patent No.: US 10,065,770 B2
(45) Date of Patent: Sep. 4, 2018

(54) CARTON WITH PLASTIC RECLOSABLE HEADER

(75) Inventors: Clifton Howell, Buford, GA (US); David Wallace, Lilburn, GA (US); Kenny McCracken, Dacula, GA (US); Kevin Owen, Flowery Branch, GA (US); Rusty Koenigkramer, Nanuet, NY (US); Robert Hogan, Burr Ridge, IL (US); Eric Plourde, Frankfort, IL (US); David Anzini, Middletown, NY (US); Steven Ausnit, New York, NY (US)

(73) Assignee: ILLINOIS TOOL WORKS INC., Glenview, IL (US)

( * ) Notice: Subject to any disclaimer, the term of this patent is extended or adjusted under 35 U.S.C. 154(b) by 1557 days.

(21) Appl. No.: 12/922,541

(22) PCT Filed: Sep. 13, 2010

(86) PCT No.: PCT/US2010/048617

§ 371 (c)(1),
(2), (4) Date: Aug. 10, 2011

(87) PCT Pub. No.: WO2011/043896

PCT Pub. Date: Apr. 14, 2011

(65) Prior Publication Data

US 2011/0301006 A1 Dec. 8, 2011

Related U.S. Application Data

(60) Provisional application No. 61/249,852, filed on Oct. 8, 2009, provisional application No. 61/298,429, filed on Jan. 26, 2010.

(51) Int. Cl.
*B65D 5/12* (2006.01)
*B65D 33/25* (2006.01)
(Continued)

(52) U.S. Cl.
CPC ..... *B65D 33/2508* (2013.01); *B65D 5/064* (2013.01); *B65D 5/12* (2013.01);
(Continued)

(58) Field of Classification Search
USPC ..... 53/452, 329, 133.3, 329.2, 133.4, 53/456–459, 51, 242, 128.1; 493/84,
(Continued)

(56) References Cited

U.S. PATENT DOCUMENTS 2,100,739 A 11/1937 Gilfillan
3,054,434 A 9/1962 Ausnit
(Continued)

FOREIGN PATENT DOCUMENTS

JP H02-016748 1/1990
JP H07-089558 4/1995
(Continued)

OTHER PUBLICATIONS

Julie Strietelmeier, QuickSeals, The Gadgeteer, http://the-gadgeteer.com/2007/03/05/quickseals/, Mar. 5, 2007.

*Primary Examiner* — Christopher R Harmon
(74) *Attorney, Agent, or Firm* — McCarter & English, LLP

(57) ABSTRACT

The disclosure relates to a method and apparatus for manufacturing a package with a rigid or semi-rigid container and a polymeric or plastic header with a reclosure, such as a zipper. The rigid or semi-rigid container is typically provided in a stack of flat containers. The header is sealed, glued or otherwise secured to the containers. The container, typically inverted, is filled, and the bottom is formed by folding and sealing the bottom portion of the container.

55 Claims, 31 Drawing Sheets

(51) Int. Cl.

| | |
|---|---|
| ***B65D 8/00*** | (2006.01) |
| ***B65D 75/58*** | (2006.01) |
| ***B65D 5/06*** | (2006.01) |
| ***B65D 5/60*** | (2006.01) |
| *B65D 65/46* | (2006.01) |
| *B31B 50/26* | (2017.01) |
| *B31B 50/64* | (2017.01) |
| *B31B 120/30* | (2017.01) |
| *B31B 105/00* | (2017.01) |
| *B31B 50/00* | (2017.01) |
| *B31B 50/81* | (2017.01) |
| *B31B 50/86* | (2017.01) |

(52) U.S. Cl.
CPC ..... *B65D 5/606* (2013.01); *B65D 15/22* (2013.01); *B65D 33/2516* (2013.01); *B65D 33/2591* (2013.01); *B65D 75/58* (2013.01); *B31B 50/0044* (2017.08); *B31B 50/26* (2017.08); *B31B 50/64* (2017.08); *B31B 50/8144* (2017.08); *B31B 50/87* (2017.08); *B31B 2105/00* (2017.08); *B31B 2120/30* (2017.08); *B65D 65/466* (2013.01)

(58) Field of Classification Search
USPC ..... 493/93–95, 87, 210, 212–215
See application file for complete search history.

(56) References Cited

U.S. PATENT DOCUMENTS

| | | | | |
|---|---|---|---|---|
| 3,113,712 | A | | 12/1963 | Kindseth |
| 3,325,084 | A | | 6/1967 | Ausnit |
| 3,750,932 | A | | 8/1973 | Ellison |
| 3,765,593 | A | | 10/1973 | D'Alessio |
| 3,959,856 | A | | 6/1976 | Ausnit |
| 4,347,970 | A | | 9/1982 | Nardone |
| 4,471,884 | A | * | 9/1984 | Kuchenbecker ..... 229/164.2 |
| 4,520,957 | A | | 6/1985 | Lisiecki |
| 4,657,176 | A | | 4/1987 | Matsubara |
| 4,665,552 | A | | 5/1987 | Lems et al. |
| 4,669,253 | A | * | 6/1987 | Shavit ..... 53/455 |
| 4,691,373 | A | * | 9/1987 | Ausnit ..... 383/63 |
| 4,736,451 | A | | 4/1988 | Ausnit |
| 4,787,880 | A | | 11/1988 | Ausnit |
| 4,846,585 | A | | 7/1989 | Boeckmann |
| 4,874,257 | A | | 10/1989 | Inagaki |
| 4,892,512 | A | * | 1/1990 | Branson ..... 493/194 |
| 4,923,309 | A | | 5/1990 | Van Erden |
| 4,925,316 | A | | 5/1990 | Van Erden et al. |
| 4,949,527 | A | * | 8/1990 | Boeckmann et al. ..... 53/412 |
| 5,024,537 | A | | 6/1991 | Tilman |
| 5,080,253 | A | | 1/1992 | Zieke |
| 5,163,269 | A | * | 11/1992 | Williams ..... 53/412 |
| 5,174,658 | A | | 12/1992 | Cook et al. |
| 5,215,380 | A | * | 6/1993 | Custer ..... B29C 65/7855 383/203 |
| RE34,554 | E | | 3/1994 | Ausnit |
| 5,322,211 | A | | 6/1994 | Peterson |
| 5,366,294 | A | * | 11/1994 | Wirth et al. ..... 383/210.1 |
| 5,405,561 | A | | 4/1995 | Dais et al. |
| 5,412,924 | A | | 5/1995 | Ausnit |
| 5,422,130 | A | | 6/1995 | Fox et al. |
| 5,509,734 | A | | 4/1996 | Ausnit |
| 5,520,463 | A | | 5/1996 | Tilman |
| 5,651,462 | A | * | 7/1997 | Simonsen et al. ..... 206/557 |
| 5,690,600 | A | * | 11/1997 | Yang et al. ..... 493/212 |
| 5,902,427 | A | | 5/1999 | Zinke et al. |
| 5,941,643 | A | | 8/1999 | Linkiewicz |
| 5,972,396 | A | | 10/1999 | Jurgovan |
| 6,006,984 | A | | 12/1999 | Chung et al. |
| 6,021,557 | A | | 2/2000 | Dais et al. |
| 6,029,885 | A | | 2/2000 | Mueller |
| 6,030,122 | A | | 2/2000 | Ramsey |
| 6,063,416 | A | | 5/2000 | Teasdale et al. |
| 6,110,512 | A | | 8/2000 | Teasdale |
| 6,131,370 | A | | 10/2000 | Ausnit |
| 6,138,439 | A | * | 10/2000 | McMahon et al. ..... 53/412 |
| 6,167,597 | B1 | | 1/2001 | Malin |
| 6,177,172 | B1 | | 1/2001 | Yeager |
| 6,217,497 | B1 | | 4/2001 | Laudenberg |
| 6,290,392 | B1 | | 9/2001 | Sandor |
| 6,299,353 | B1 | | 10/2001 | Piechocki |
| 6,317,943 | B1 | | 11/2001 | Wood |
| 6,347,885 | B1 | | 2/2002 | Buchman |
| 6,360,513 | B1 | | 3/2002 | Strand et al. |
| 6,427,421 | B1 | | 8/2002 | Belmont |
| 6,609,827 | B2 | | 8/2003 | Bois et al. |
| 6,688,515 | B1 | | 2/2004 | Huffman et al. |
| 6,740,019 | B2 | * | 5/2004 | Bois ..... 493/156 |
| 6,827,491 | B2 | | 12/2004 | Kohl et al. |
| 6,863,754 | B2 | | 3/2005 | Wright et al. |
| 6,899,460 | B2 | | 5/2005 | Turvey et al. |
| 6,908,422 | B2 | | 6/2005 | Ichikawa et al. |
| 6,928,794 | B2 | * | 8/2005 | Hamer et al. ..... 53/450 |
| 6,955,465 | B2 | | 10/2005 | Machacek |
| 7,004,378 | B1 | | 2/2006 | Tharpe, Jr. |
| 7,137,736 | B2 | | 11/2006 | Pawloski |
| 7,160,029 | B2 | | 1/2007 | Bein |
| 7,179,215 | B2 | | 2/2007 | Focke et al. |
| 7,207,716 | B2 | | 4/2007 | Buchanan |
| 7,241,046 | B2 | | 7/2007 | Piechocki |
| 7,419,300 | B2 | * | 9/2008 | Pawloski et al. ..... 383/14 |
| 7,478,950 | B2 | | 1/2009 | Plourde et al. |
| 7,524,111 | B1 | | 4/2009 | Williams |
| 8,220,651 | B2 | * | 7/2012 | Norcom ..... 220/1.6 |
| 8,672,214 | B2 | | 3/2014 | Manaige |
| 2003/0100424 | A1 | | 5/2003 | Barmore et al. |
| 2004/0250510 | A1 | | 12/2004 | Dalietos et al. |
| 2005/0036720 | A1 | | 2/2005 | Olin |
| 2005/0194386 | A1 | | 9/2005 | Shai |
| 2005/0230390 | A1 | | 10/2005 | Glenn |
| 2006/0137997 | A1 | | 6/2006 | Bein et al. |
| 2006/0198561 | A1 | | 9/2006 | Cordeliesse |
| 2006/0239594 | A1 | | 10/2006 | Ishizaki et al. |
| 2007/0221713 | A1 | | 9/2007 | Wilson et al. |
| 2007/0258666 | A1 | | 11/2007 | Plourde |
| 2008/0050052 | A1 | | 2/2008 | Vanloocke et al. |
| 2008/0159664 | A1 | | 7/2008 | Share et al. |
| 2008/0240628 | A1 | | 10/2008 | Vanloocke et al. |
| 2009/0120828 | A1 | | 5/2009 | Sanfilippo |
| 2009/0142006 | A1 | | 6/2009 | Wine et al. |
| 2011/0017812 | A1 | | 1/2011 | Belko et al. |
| 2011/0017814 | A1 | | 1/2011 | Belko et al. |

FOREIGN PATENT DOCUMENTS

| | | |
|---|---|---|
| JP | 2002104511 | 4/2002 |
| JP | 2007-069944 | 3/2007 |
| WO | WO2006093904 | 9/2006 |
| WO | WO20066093905 | 9/2006 |
| WO | WO2011/011283 A2 | 1/2011 |

* cited by examiner

CARTON WITH PLASTIC RECLOSABLE HEADER

This application claims priority under 35 U.S.C. § 119(e) of provisional patent application Ser. No. 61/249,852, filed on Oct. 8, 2009 and provisional patent application Ser. No. 61/298,429, filed Jan. 26, 2010, the contents of both of which are incorporated by reference in their entirety.

BACKGROUND OF THE DISCLOSURE

Field of the Disclosure

The present disclosure relates to a method and apparatus for producing a package with a carton-type container made from paper, cardboard, chipboard or similar rigid or semi-rigid material with attached thereto a reclosable header section made from plastic, polymer or other flexible material, the reclosable structure being typically a zipper, but not limited thereto. The present disclosure likewise relates to the resulting package.

Description of the Prior Art

In the prior art, it is known to make reclosable flexible plastic bags for the sale of foodstuffs or other consumer products. The bags or packages, while well suited for their intended uses, have typically not been used for food products that would easily be crushed or damaged during shipment. Additionally, such bags or packaging can result in inefficiencies in storage, transportation and display.

Likewise, traditional cardboard boxes are well-known for the packaging and marketing of such well-established products as cereal. However, these boxes typically are heavy and require an internal waxed paper or similar liner, typically tearable and therefore not resealable and do not protect the contents after initial opening. This increases manufacturing costs and typically does not allow the package to be filled completely with product, thereby resulting in inefficiencies in space, which increases the costs for storage, transportation and display of the product. Therefore, many of these traditional cardboard boxes, particularly those with a tearable plastic liner, have been less than satisfactory in their reclosable capabilities.

There have been several attempts at packages to address these deficiencies, but none have been entirely satisfactory. These previous attempts include those disclosed in U.S. Pat. No. 7,524,111 entitled "Rigid-Bottomed Resealable Bag with Handles", issued on Apr. 28, 2009 to Williams; U.S. Pat. No. 7,207,716 entitled "Flexible Container Having Flat Walls", issued on Apr. 24, 2007 to Buchanan; U.S. Pat. No. 7,160,029 entitled "Enclosure for Resealing a Package and Method Therefor", issued on Jan. 9, 2007 to Bein; U.S. Pat. No. 6,908,422 entitled "Reclosable Packaging Bag and Method for Manufacturing Same", issued on Jun. 21, 2005 to Ichikawa et al.; U.S. Pat. No. 6,110,512 entitled "Package and Merchandiser", issued on Aug. 29, 2000 to Teasdale; U.S. Pat. No. 6,063,416 entitled "Procedure and Package to Enable Peg Display of Food Pouch in Tent-Style Paperboard Carton", issued on May 16, 2000 to Teasdale et al.; U.S. Pat. No. 4,691,373 entitled "Zipper Closure with Unitary Adhesive Cover Sheet", issued on Sep. 1, 1987 to Ausnit; and U.S. Published Patent Application No. 2005/0194386, entitled "Zipper Box Covers" published on Sep. 8, 2005 for Shai; and Japanese Patent No. 2002104511 entitled "Bag-in-Carton", published on Apr. 10, 2002 for Makoto et al.

SUMMARY AND OBJECTS OF THE DISCLOSURE

It is therefore an object of the present disclosure to provide a reclosable package which has rigid walls thereby providing a high capacity, space-efficient package with a flat printing surface thereby providing protection for the packaging of crushable or delicate products.

It is therefore a further object of the present disclosure to provide a package which is light in weight and which is typically reclosable.

These and other objects are attained by the present disclosure by providing a package, along with a method and apparatus for the production thereof, which includes a rigid or semi-rigid carton-type container and, attached thereto, a plastic, polymer, or similar flexible header, typically with a reclosable zipper configuration, but not limited thereto.

BRIEF DESCRIPTION OF THE DRAWINGS

Further objects and advantages of the disclosure will become apparent from the following description and from the accompanying drawings, wherein.

DETAILED DESCRIPTION OF THE PREFERRED EMBODIMENTS

Figure 1:
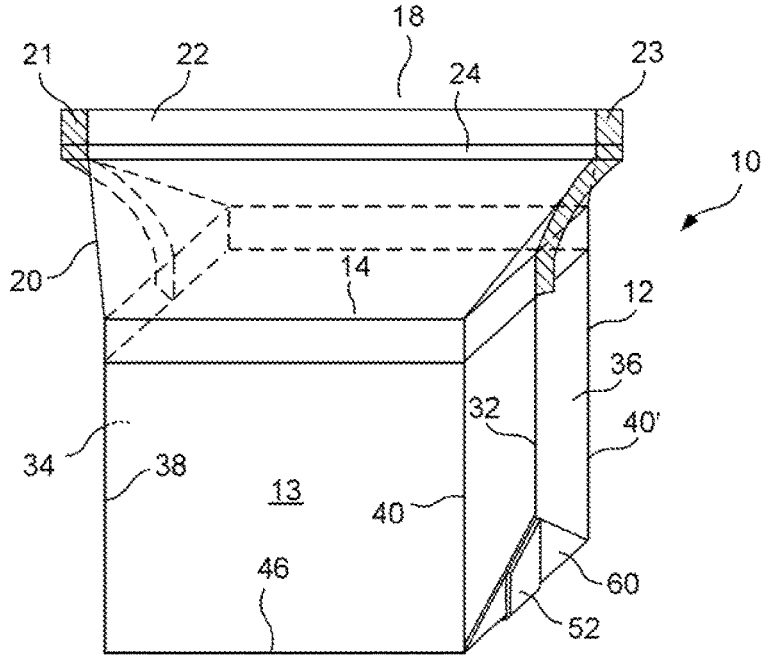
FIG. 1 is a perspective view of an embodiment of a package of the present disclosure, shown in a filled configuration with a sealed bottom and an upwardly projecting header.
Figure 2:
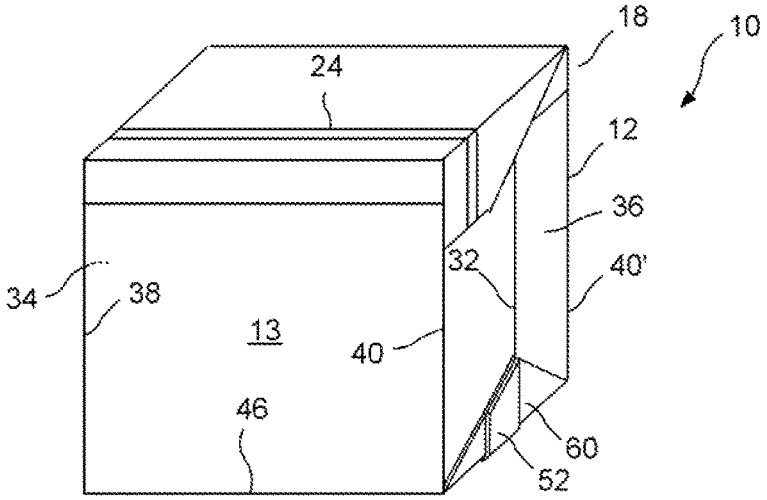
FIG. 2 is a perspective view of an embodiment of a package of the present disclosure, shown in a filled configuration with a sealed bottom and a flush header.
Figures 3A, 3B, 3C:
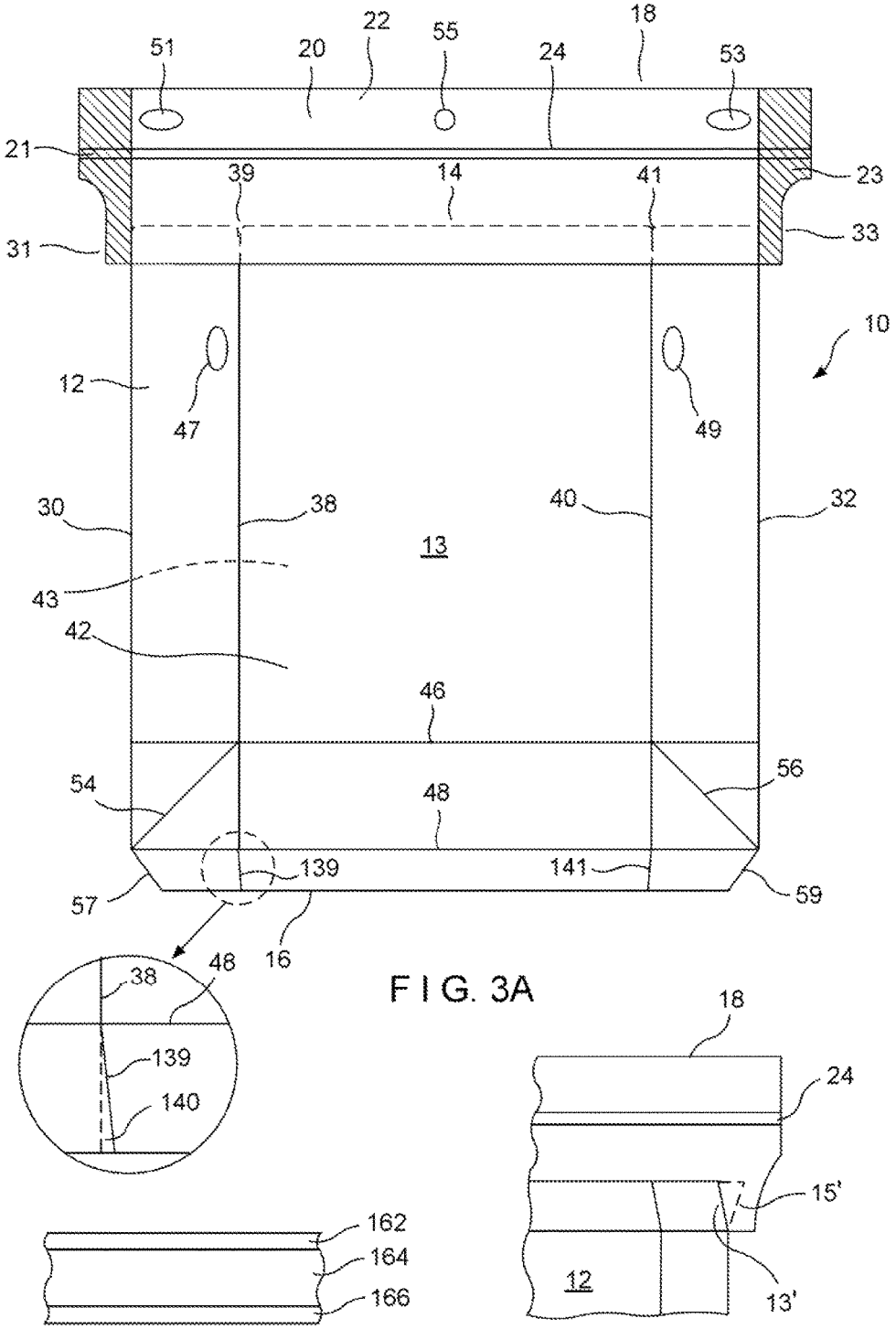
FIG. 3A is a plan front view of an embodiment of a package of the present disclosure, shown in a flat, unfilled configuration, with an upwardly projecting header and an unsealed bottom.
FIG. 3B is a cross-sectional view of typical material used for the rigid or semi-rigid container portion of embodiments of the present disclosure.
FIG. 3C is a perspective view showing the header attached to the interior of the container portion of the package.

Referring now to the drawings in detail wherein like numerals indicate like elements throughout the several views, one sees that FIG. 1 is a perspective view of an embodiment of the package 10 of the present disclosure. Package 10 includes a rigid, semi-rigid or fibrous carton-type container 12, typically with a central layer 164 (FIG. 3B) made from a paper product such as fiberboard or chipboard and an interior surface 166 with an oxygen barrier and a moisture barrier and a poly-coated outer layer 162, but is not limited thereto (hereinafter, collectively referred to as a "semi-rigid container"). Semi-rigid container 12 is typically initially provided in a flat configuration as shown in FIG. 3A with an open top or mouth 14 and an open bottom 16. Package 10 further includes a plastic or polymeric header 18 (typically applied by heat, adhesive or glue) which includes first and second sidewalls 20, 22 and a reclosure (or closure) 24, illustrated as a zipper with first and second interlocking profiles 25, 27 (see FIG. 6B), but is not limited thereto. Other examples of reclosures include, but are not limited to, flanged zippers with opening lips, flanged tamper-resistant zippers, tamper-evident zippers, flanged zippers with sliders (see FIG. 23), flanged zippers without sliders, string (flangeless) zippers, double zippers (see FIG. 27I), multiple track zippers, zippers with a tear line, a zipper with flanges connected above the locking elements, zippers with flanges connected below the locking elements, leak-resistant zippers, zippers with a peel seal, hinged zippers, zippers with spot seals, zippers with eyemarks, partly sealed zippers, zippers with shape-retaining characteristics, pinch grip pull zippers (i.e., lower product side opening strength than consumer side opening strength), zipper tape (especially for applications involving frozen foods), hook-and-eye (i.e., Velcro®), reclosable adhesives, perforated cap zipper tape, laminated zipper tape with a tear bead, zippers with a weakened line of resistance, zippers with a wedge, zippers with a stabilizing post, zippers with guide ribs, zippers with a compression post, and fitments. These terms are known to those skilled in the art, and the corresponding zippers are disclosed in patents incorporated by reference in their entirety hereinafter. Additionally, in some applications, a peel seal may be substituted for the reclosure. Similarly, examples of the web from which header 18 is manufactured includes, but are not limited to, film with eyemarks, printed film (see FIG. 22), film with cut-outs, film with diagonal seals and film with tear-lines. The header 18 is sealed or glued to the mouth 14 of semi-rigid container 12. First and second cross-seals 21, 23 or other methods of attachment are formed at the ends of header 18 between the sidewalls 20, 22, immediately outwardly adjacent from first and second folded edges (or first and second exterior folds) 30, 32. The first and second cross-seals 21, 23 further typically include respective first and second side incisions or notches 31, 33 in order to remove material to aid in the subsequent folding of the header 18 into the position shown in FIG. 2. Other shapes, such as single or multiple radius cut-outs are also envisioned. It is noted that it is envisioned that some applications may fold the header 18 onto the top of the package 10. However, it will be preferred in many applications that the reclosure or zipper 24 not be bent 180 degrees. The header 18 may be made with bio-degradable plastic. Additionally, in such an embodiment, the sealant for semi-rigid container 12 would also be made bio-degradable.

Figure 5A:
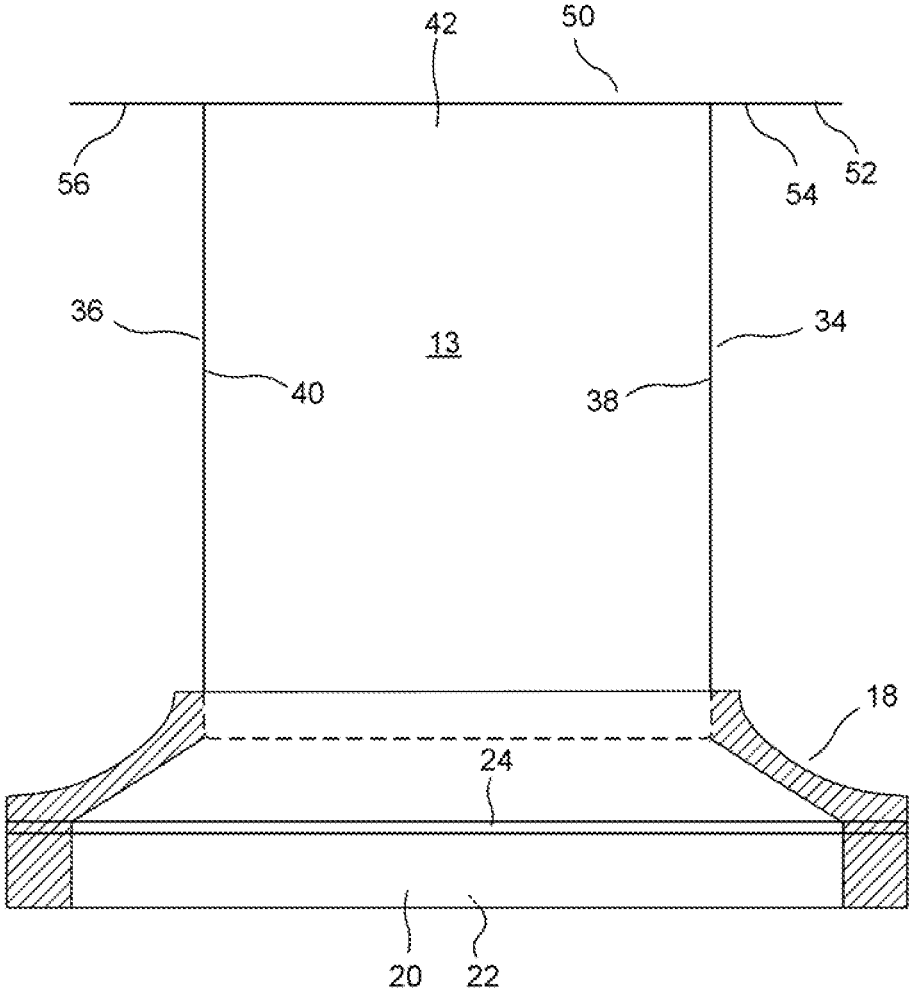
FIG. 5A is a plan view of an embodiment of an inverted package of the present disclosure, showing the bottom partially folded, typically after bottom filling, with the bottom fin seal folded flush with the bottom of the package.
Figure 7:
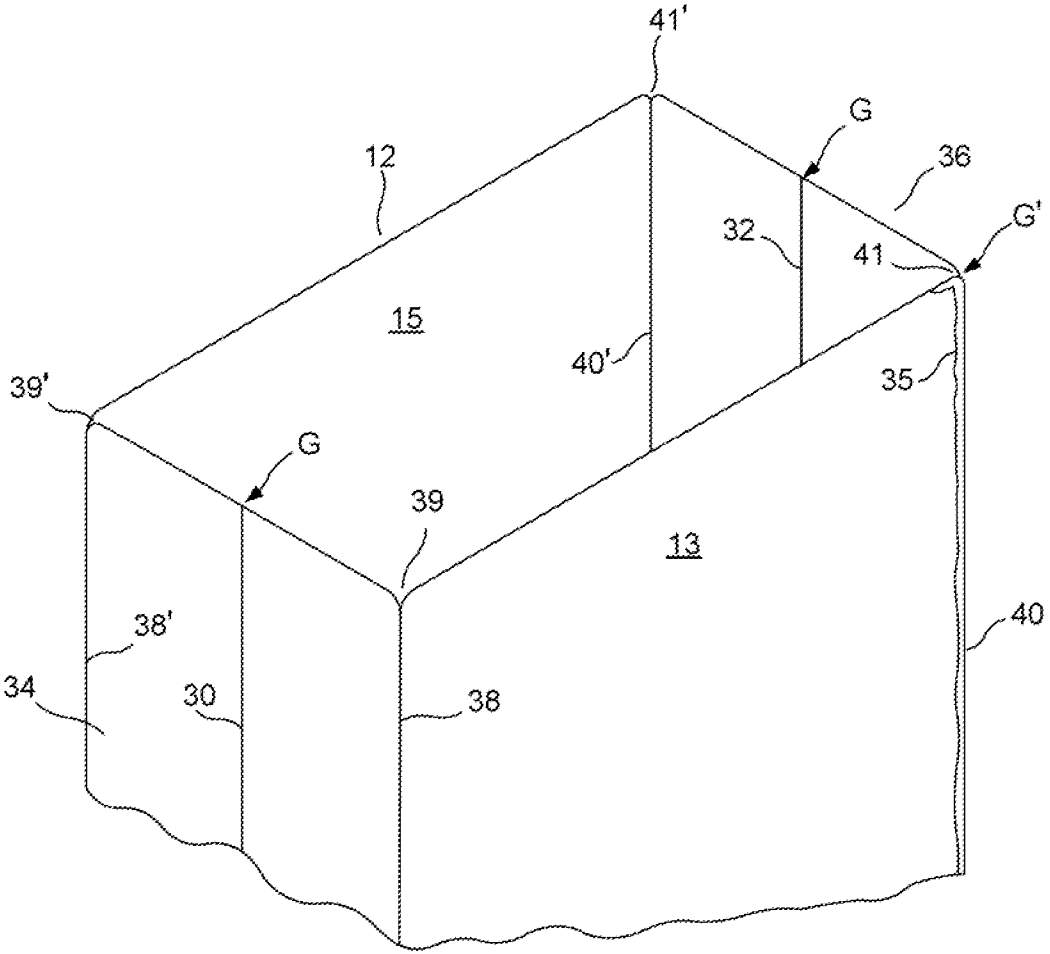
FIG. 7 is a perspective view of the top of the rigid or semi-rigid container portion of an embodiment of the package of the present disclosure, showing a radius or chamfer formed at the corners thereof.

As shown in FIG. 3A, semi-rigid container 12 is typically initially provided in a flat state with front panel 13 and rear panel 15. Semi-rigid container 12 is typically partially or fully poly-coated on exterior surface 162 (FIG. 3B), particularly in the areas where heat sealing is required, such as the top of semi-rigid container 12 where header 18 is attached, and the portions of semi-rigid container 12 where the bottom is sealed shut before or after filling. Alternately, adhesive is applied in the required areas and the attachment is done by these adhesives. Additionally, interior coating or lamination may include other materials required for the necessary barrier properties, including hermeticity and oxygen-moisture barriers. While illustrated in FIG. 3A (see FIG. 22), front and rear panels 13, 15 typically have printing including advertising and product information in text and graphics form on the exterior thereof, such as most products commonly found in a grocery store or other retail establishment. Front panel 13 and rear panel 15 are joined to each other by first and second folded edges 30, 32 which ultimately become the central folds of the first and second gusseted sides 34, 36 of semi-rigid container 12 in the expanded or filled configuration as shown in FIGS. 1 and 2. Front panel 13 of semi-rigid container 12 further includes first and second front interior vertical folds 38, 40 which are inwardly adjacent from and parallel to first and second folded edges 30, 32. In the expanded or filled configurations as shown in FIGS. 1 and 2, first and second front interior vertical folds 38, 40 form the transition from the front surface 42 to the gusseted sides 34, 36. Similar first and second rear interior vertical folds 38', 40' are formed on the rear of the semi-rigid container 12, see FIGS. 5A and 5B, forming the transition from the rear surface 43 to the gusseted sides 34, 36. As shown in FIG. 7, as well as FIG. 3A, the upper ends of vertical folds 38, 38', 40, 40' may terminate in chamfered sections 39, 39', 41, 41', respectively, in order to prevent cracking of the material of semi-rigid container 12 during folding and further to reduce the likelihood of the material of semi-rigid container 12 forming a point to puncture the material of header 18. Similarly, as shown in FIG. 7, in order to prevent leakage between header 18 (not shown in FIG. 7) and semi-rigid container 12, extra dots of glue (indicated as "G") are provided at the top of first and second folded edges 30, 32 within first and second gusseted sides 34, 36. Additionally, as semi-rigid container 12 is typically formed from a single sheet of material with a seam 35 formed at the overlapping joinder of the edges (shown in FIG. 7 as occurring at second interior vertical fold 40) an extra dot of glue (indicated as "G'") is provided at the top of seam 35 in order to prevent leakage between the semi-rigid container 12 and the header 18 due to the transition in thickness caused by seam 35. Other embodiments may use an even number (four or greater) of panels.

Returning to FIG. 3A, one sees that first and second interior horizontal folds 46, 48 are formed on front panel 13 adjacent to the bottom 16. Similar first interior horizontal fold 46' is formed on the rear panel 15 of semi-rigid container 12, see FIGS. 5A, 5B. The first interior horizontal folds 46, 46' are used to form the transition to the bottom surface 50 while the second interior horizontal fold 48 is used to form the fin seal 52 as shown in FIGS. 4A, 4B, 5A and 5B. A second horizontal fold is not illustrated on the rear panel 15, as typically, only one of panels 13, 15 include a second horizontal fold in order to help force the fin seal 52 to fold in a specific direction. As shown in the area of detail of FIG. 3A, the lower portions of first and second front interior vertical folds 38, 40 form respective first and second inwardly inclined fold portions 139, 141. As shown in the area of detail of FIG. 3A, an angle of typically 1-4 degrees, or preferably 2-3 degrees in most applications, is formed between the projection of respective front interior vertical folds 38, 40 (with substantially identical construction on the rear of semi-rigid container 12) and inwardly inclined fold portions 139, 141, so that the inwardly inclined fold portions 139, 141 incline or veer toward the center of the semi-rigid container 12 as the inwardly inclined fold portions 139, 141 approach the open bottom 16. This aids in the subsequent folding of the semi-rigid container 12 into the package 10.

As further shown in FIG. 3A, corresponding first and second oval-shaped partially scored portions 47, 49 (typically cutting through a first layer of a multi-laminate or coated surface, however other similar methods, such as compressing, are considered to be within the definition of scoring) are formed with a vertical major axis on semi-rigid container 12 immediately below header 18, outwardly adjacent from first and second front interior vertical folds 38, 40 (thereby being located within the gusseted sides after the package 10 has been formed). During the formation of the package 10 from the semi-rigid container 12 and header 18, corresponding first and second oval-shaped dots of glue 51, 53 (with a horizontal major axis) are placed on one side of front of header 18, typically above reclosure or zipper 24 and inwardly adjacent from respective first and second cross-seals 21, 23. Additionally, a dot of glue 55 may be placed just below the mid-point of the top edge of header 18. Typically, hot melt glue is used, but other glues or adhesives may be applicable to various applications. During formation of the package 10 from the semi-rigid container 12 and header 18, the header 18 is folded down against the sides of the formed semi-rigid container 12 so that first and second oval-shaped dots of glue 51, 53 cover and are glued or otherwise secured to respective first and second oval-shaped partially scored portions 47, 49. Similarly, dot of glue 55 tacks the top edge of header 18 against the folded-down sidewall 20. Thereafter, when the user lifts the header 18 so as to break the connection formed by first and second oval-shaped dots of glue 51, 53, typically only the relatively well-defined first and second oval-shaped partially scored portions 47, 49 are torn from the semi-rigid container 12, with little or no unsightly fiber tears. First and second oval-shaped partially scored portion 47, 49 are typically provided only on the front of semi-rigid container 12. Otherwise, the front and rear views of semi-rigid container 12 are substantially identical. Alternately, releasable configurations may be used to attach the folded header to the sides of the formed semi-rigid container, such as, but not limited to, releasable adhesives, hook-and-eye (Velcro®), multiple strips, etc.

Figure 4A:
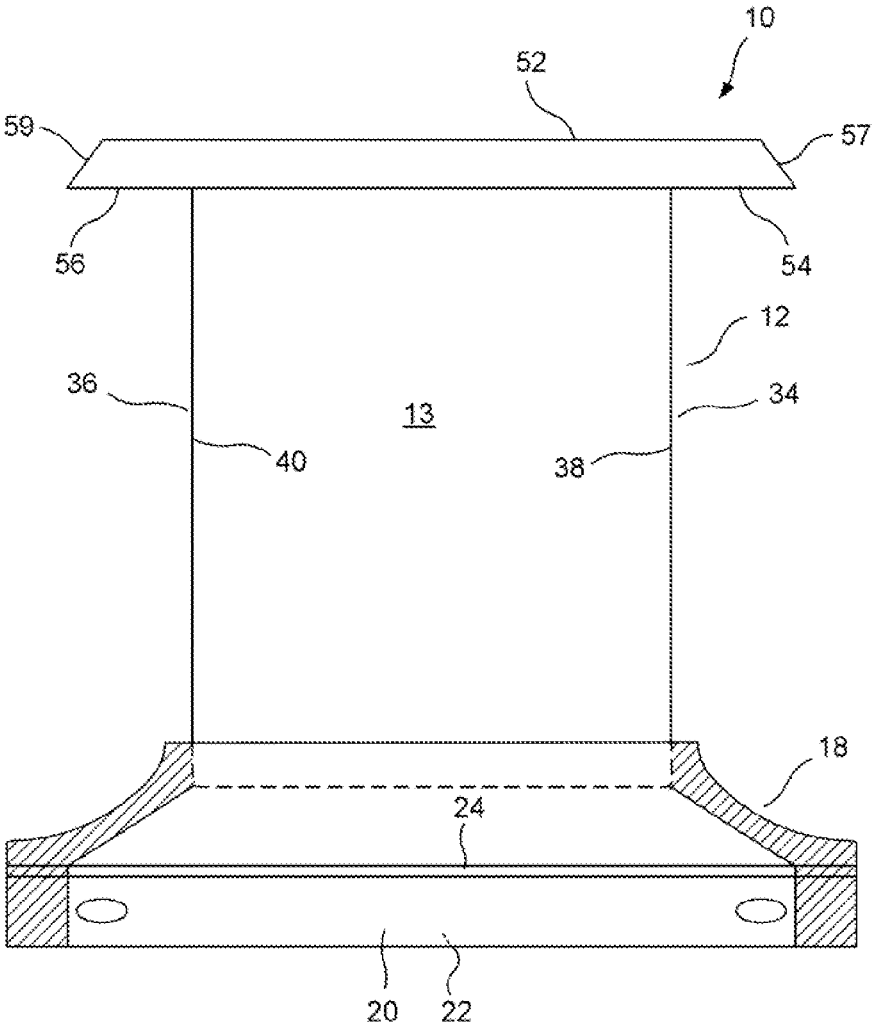
FIG. 4A is a plan view of an embodiment of an inverted package of the present disclosure, showing the bottom partially folded, typically after bottom filling, with the bottom fin seal pointing upwardly.
Figure 4B:
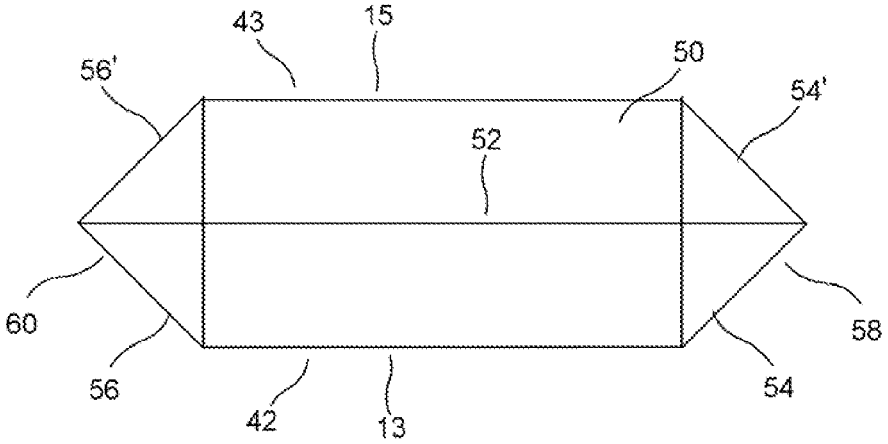
FIG. 4B is a plan view from above of the embodiment of the inverted package of FIG. 4A.
Figure 5B:
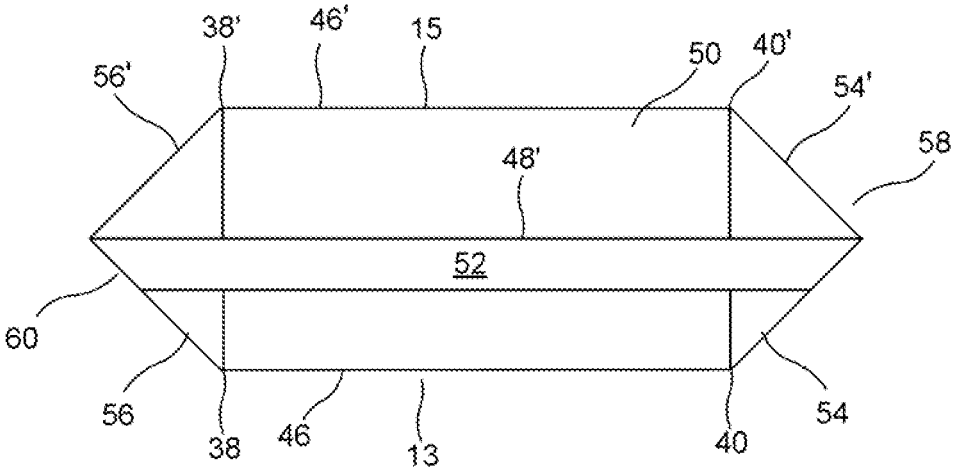
FIG. 5B is a plan view from above of the embodiment of the inverted package of FIG. 5A.
Figure 6A:
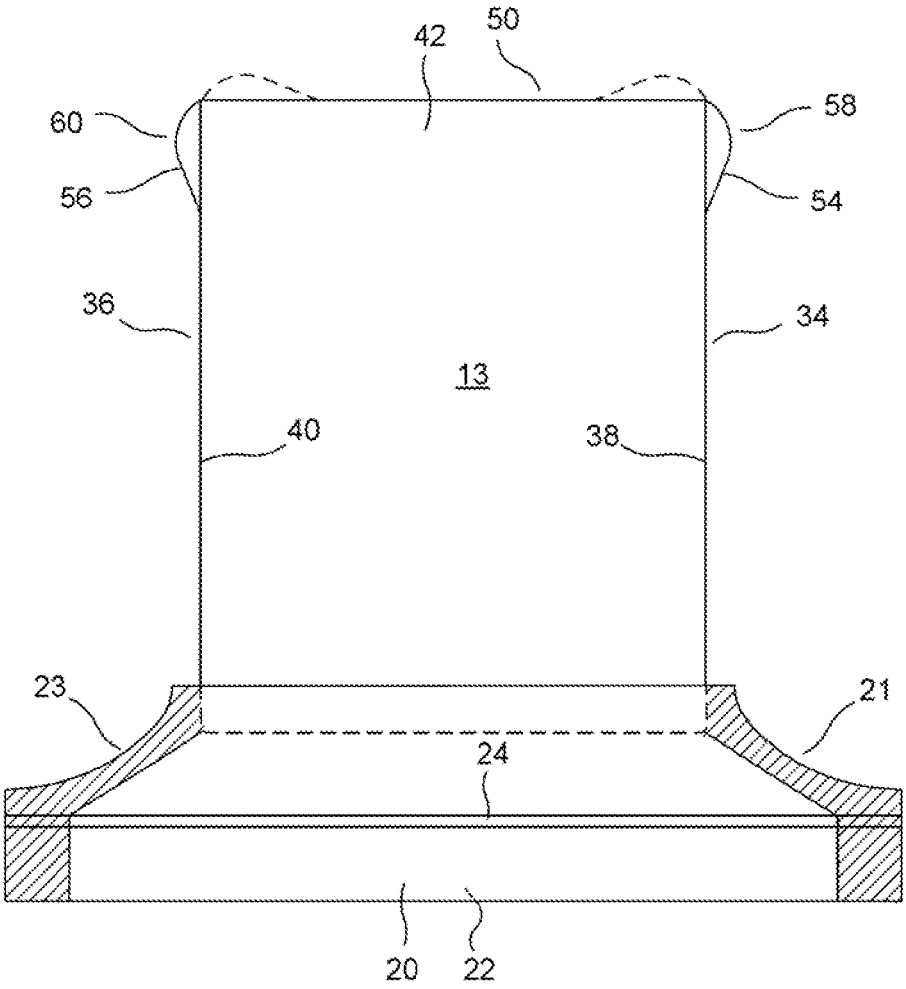
FIG. 6A is a plan view of an embodiment of an inverted package of the present disclosure, similar to FIG. 1, showing the ears of the bottom folded against the sides of the package and sealed thereto, typically after bottom filling.
Figure 6C:
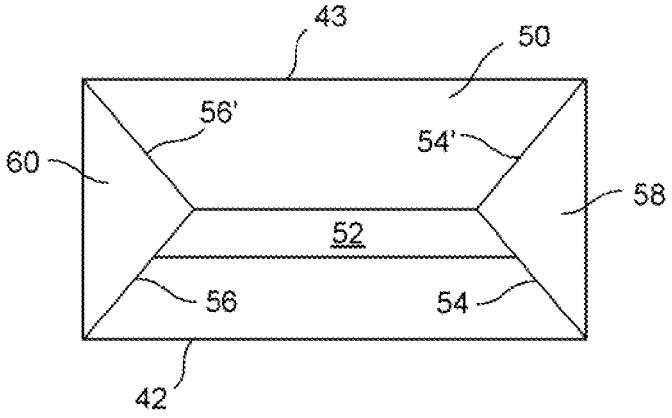
FIG. 6C is a bottom view of an embodiment of the package, shown with the ears folded and sealed to the bottom of the package.
Figure 6B:
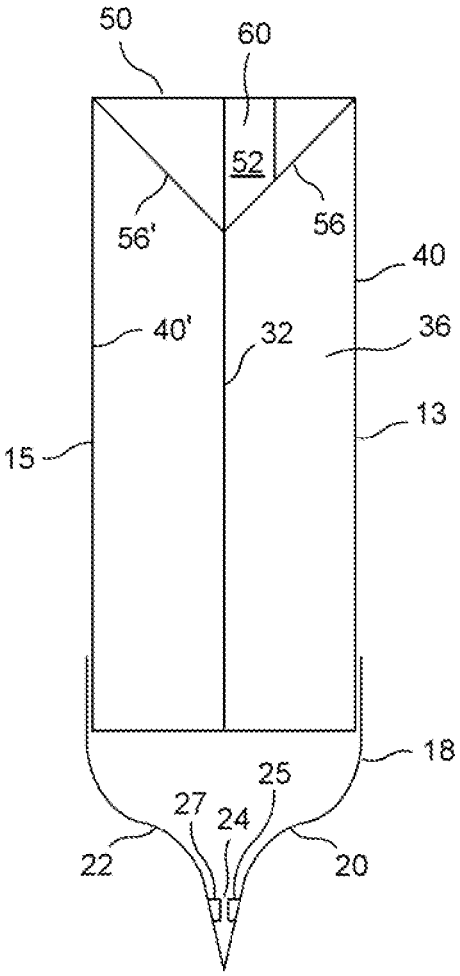
FIG. 6B is a side plan view of the embodiment of the inverted package of FIG. 5A.

First diagonal fold 54 extends from the intersection of first interior vertical fold 38 and first horizontal fold 46 to the intersection of first folded edge 30 and second horizontal fold 48. Similarly, second diagonal fold 56 extends from the intersection of second interior vertical fold 40 and first horizontal fold 46 to the intersection of second folded edge 32 and second horizontal fold 48. Additionally, as shown in FIG. 3A, the lower corners are removed by first and second lower cuts 57, 59 which extend diagonally from the respective ends of second horizontal fold 48 to opposite ends of the bottom 16 of the semi-rigid container 12. This results in diagonal ends on fin seal 52 as shown in FIG. 4A. As shown in FIGS. 4B, 5B and 6B, similar first and second diagonal folds 54', 56' are formed on the rear panel 15 of semi-rigid container 12. The first and second diagonal folds 54, 54', 56, 56' are necessary for forming the diagonal edges of first and second lower triangular ears 58, 60, shown in the transitory extended position in FIGS. 4A, 4B, 5A, 5B and shown in the final sealed flush position in FIGS. 1, 2, 6A and 6B.

Figure 6D:
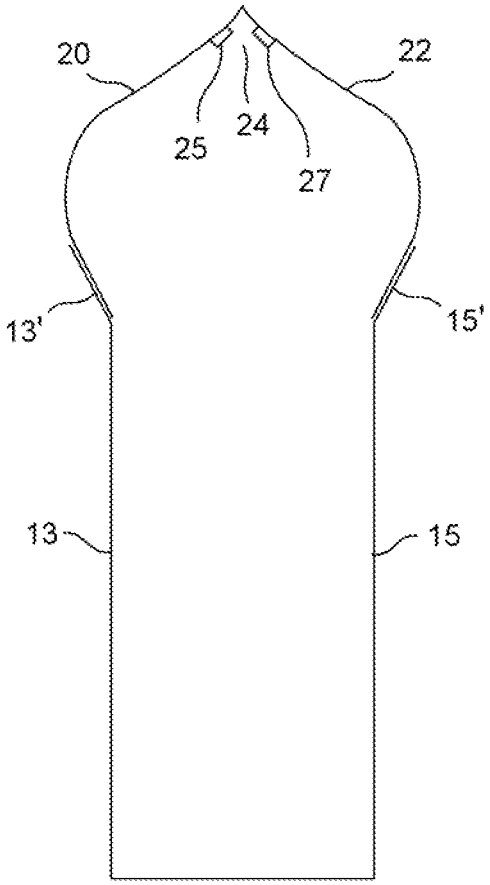
FIG. 6D is a cross-sectional view of an embodiment of the package, shown with flaps on the front and rear panels for the interior attachment of the header portion.
Figure 6E:
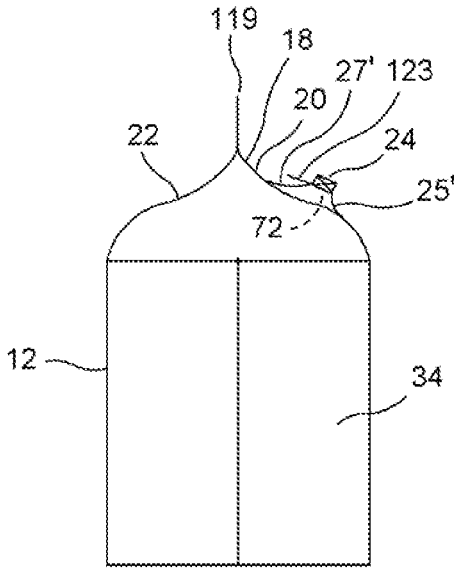
FIG. 6E is a side view of a further embodiment of the package of the present disclosure.
Figure 6G:
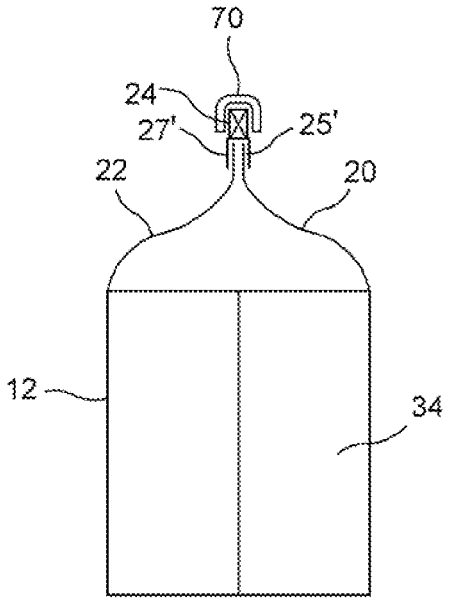
FIG. 6G is a side view of a still further embodiment of the package of the present disclosure.
Figure 6F:
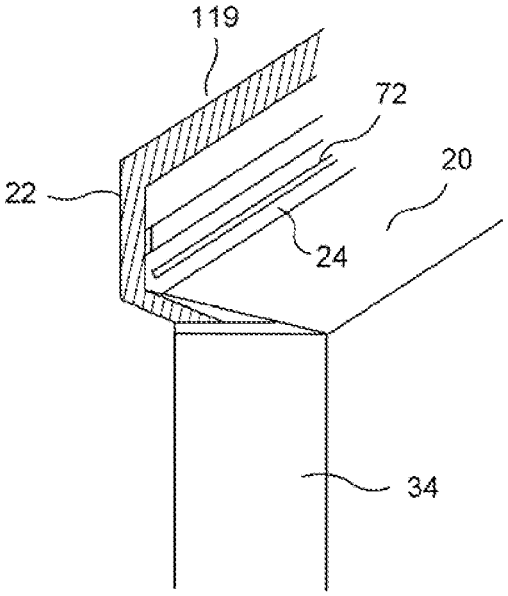
FIG. 6F is a perspective view showing the embodiment of the package of FIG. 6E, with a folded header.

FIGS. 6E and 6F illustrate a further embodiment of package 10, wherein first and second sidewalls 20, 22 may be provided as two separate sheets or a single sheet, and wherein seal 119 either joins the two separate sheets or is formed in a central location on the single sheet. Sidewall 20 includes a line of weakness 72 (which may include perforations, laser scored lines, tear beads, tear notches, linear tear lines, a peel seal, or similar structures, and may be configured as multiple lines) with first and second flanges 25', 27' of zipper 24 extending over line of weakness 72 and sealed to first sidewall 20 on opposite sides of line of weakness 72. Zipper 24 further includes an opening zipper flange 123 extending therefrom. In this position, the zipper 24 is placed on the front of the header 18, in an off-central rather than central position. A similar alternative embodiment would attach the zipper 24 on the interior of first side wall 20.

Figure 6H:
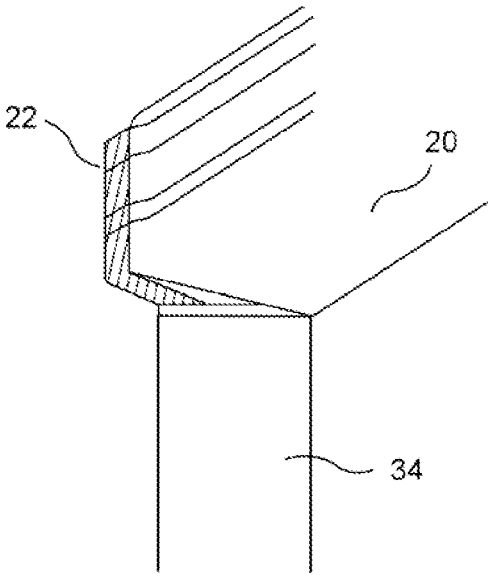
FIG. 6H is a perspective view showing the embodiment of the package of FIG. 6G, with a folded header.

FIGS. 6G and 6H illustrate a still further embodiment of package 10 wherein the sidewalls 20, 22 are provided as separate sheets (or alternately, as a single sheet with an opening or tear line therethrough) and flanged zipper 24 with slider 70 is sealed to the exterior thereof (first flange 25' sealed to sidewall 20 and a second flange 27' sealed to sidewall 22) thereby allowing the consumer to operate the slider 70 to open the zipper 24 and thereby gain access to the contents of the package 10.

Figure 8A:
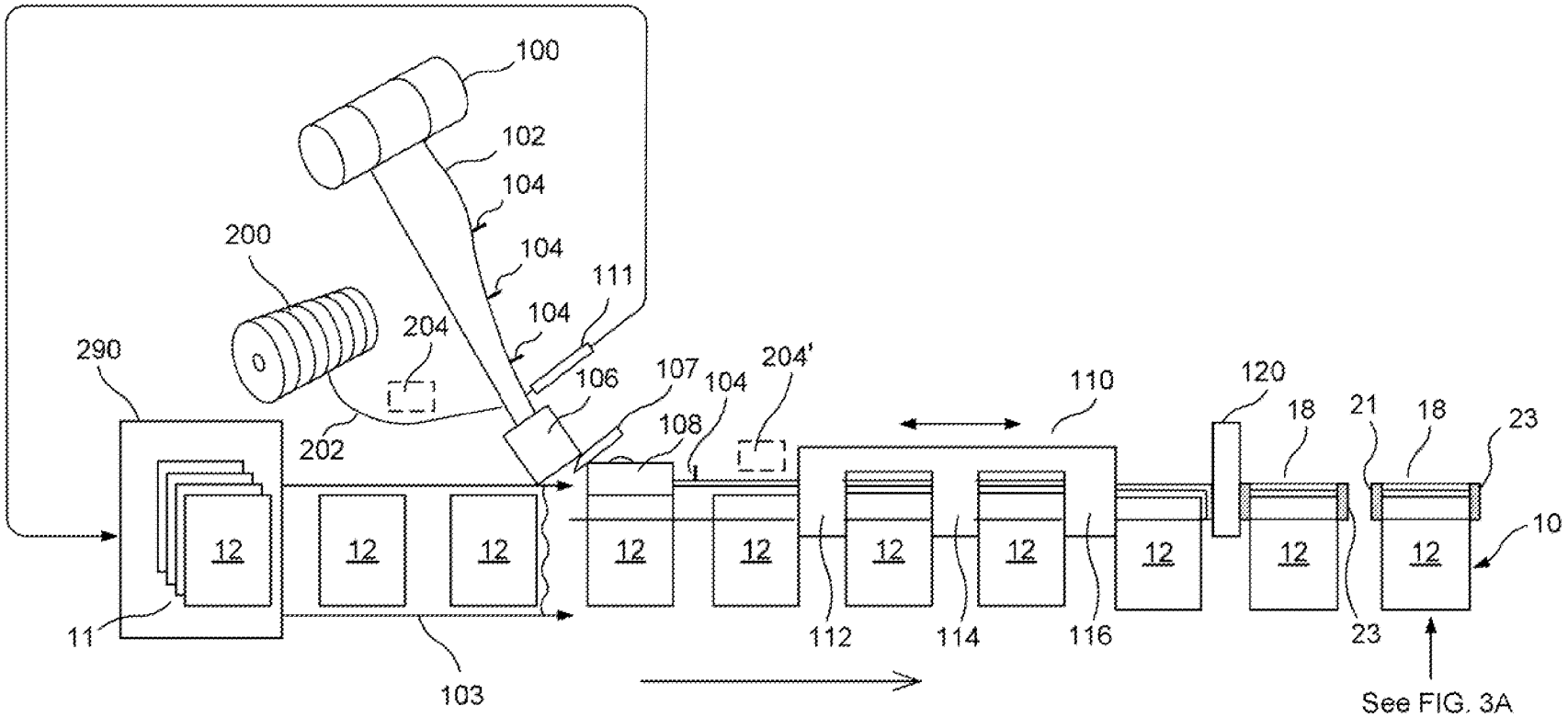
FIG. 8A is a schematic view of a first embodiment of a method and apparatus for producing the package of the present disclosure prior to filling.

FIGS. 8A-14 illustrate methods and apparatus for producing the packages 10 of FIGS. 1-7. FIGS. 8A-G and 9A-C illustrate methods and apparatus for producing the unfilled flat packages of FIG. 3A. In FIG. 8A (with many similar elements shown in the subsequent figures), a stack 11 of pre-made or previously made folded semi-rigid containers 12 is provided to a sequential feeder 290 (other sequential feeding apparatus, such as an upstream conveyor or pick-and-place apparatus, may be substituted for the stack 11 and sequential feeder 290), and the semi-rigid containers 12 are fed sequentially in a machine direction by a servo-driven conveyor 103. Web material 102 is provided from a spool 100, with periodic eyemarks 104 (in some applications, cut-outs in the web material could be substituted for eyemarks), the detection of which by eye-mark detector 111 is used to time the sequential feeding of semi-rigid containers 112 by sequential feeder 290 to conveyor 103 (the registration provided by the eyemarks 104 and the detection thereof is typically only required if the web material 102 has graphics or other printing with defined locations for the beginning and end of adjacent headers, see FIG. 22). Alternatively, the detection of the periodic eyemarks 104 can be used to vary the speed of the conveyor 103 so that the semi-rigid containers are delivered with the correct registration with respect to the web material 102. Length of zipper material 202 is provided from spool 200 and is sealed to length of web material 102 at sealing and folding station 106 (length of zipper material 202 may be configured without sliders, with pre-mounted sliders, or with sliders mounted by optional slider mounting station 204 shortly after the zipper is provided from spool 200 or mounting station 204' can be located after the zipper material is attached to the web material as shown in FIG. 8A). This sealing may be done by attaching a first flange of an interlocked zipper material 202 to unfolded web material 102 and then attaching the second flange after the web material 102 is folded around the zipper material 202. Alternately, the separate, unlocked profiles of zipper material 202 may be attached to the web material 102 and the web material 102 thereafter folded so that the profiles of zipper material 202 are aligned and interlocked (see the alternative embodiment illustrated in phantom in FIG. 8B). In another alternative, the interlocked zipper material 202 may be introduced between a folded web material 102 and then sealed or attached thereto. In yet another embodiment of the method, the zipper is attached to separate web materials. In such an embodiment, the zipper is either attached to one web in an unlocked condition, one section to each web, and thereafter, the zipper is aligned and interlocked or one side of an interlocked zipper material can be attached to one web material. Then the other web material can be attached to the other side of the zipper material. In these embodiments, the zipper can be separated at a later stage for filling the semi-rigid container through the zipper. Additionally, while the preferred method of attaching together the zipper, web, and semi-rigid containers requires several steps, this may be done in fewer steps or even simultaneously.

Typically, releasable dots of glue (other similar methods may be used) are applied to the length of web material at glue station 107 for the purpose of attaching the header 18 to the outside of formed semi-rigid container 12. At web sealing (or attaching) station 108, the length of web 102 (with the zipper 202 attached thereto) is folded (the lateral edges of which thereby form first and second sidewalls 20, 22 of header 18 of FIGS. 1-6) so as to contact semi-rigid containers 12. The lateral edges of web material 102 are glued, sealed or otherwise fastened to front and rear panels 13, 15 of semi-rigid container 12 by web sealing or attaching station 108. Sealing station 108 typically includes compression rollers and a heated bar on both sides of the web. The sealing station may include multiple heated seal bars, wherein the semi-rigid container 12, with the header 18 in position, passes through these heated bars with little to no contact pressure. After each set of seal bars, the container 12 and header 18 pass through compression rollers. The compression rollers set the film-to-film seal (i.e., cross-seals 21, 23) between the semi-rigid containers 12 and the film-to-container seal over the containers 12. These compression rollers can be free-spinning or driven. Additionally, it has been found that by pre-tensioning the film of header 18 during sealing, that the package 10 becomes more rigid. The semi-rigid containers 12 with the web material 102 attached (with the zipper material 202, in turn, attached to web material 102) move in the machine direction. A cross-sealer 110 with typically three cross-seal bars 112, 114, 116 (see FIG. 11) reciprocates so that it momentarily travels in the machine direction, tracking the movement of the semi-rigid containers 12 and the web material 102 (with zipper material 202 attached thereto), and engages the web material 102 so that a first cross-seal 21 and adjoining second cross-seal 23 of an adjacent package are simultaneously formed in three successive inter-package gaps, typically without the necessity of slowing or stopping the travel of web material 102. The use of multiple cross-seal bars (typically ultrasonic, but may include heat welding) along with the synchronized travel with the web material 102 allows for a prolonged dwell time, thereby improving sealing qualities, while maintaining high production rates. In some embodiments, a lesser or greater number of cross-seal bars may be implemented. The cross-sealer 110 then travels in the opposite direction from the machine direction to position itself for the cross-sealing operation with the successive or consecutive three inter-package gaps. The cross-seal bars 112, 114, 116 typically include a reverse knurled ultrasonic horn and a reverse knurled ultrasonic anvil as shown in FIG. 10. The reverse knurled surface creates a multitude of small pockets for the polymeric or similar material to flow during the sealing or welding of the cross-seals 21, 23. This produces high quality and aesthetically appealing cross-seals in half the time of heat and pressure sealing. It also typically removes the ambient heat that damages film during long machine stops. FIGS. 8A-G and 9A-C illustrate method and apparatus of attaching zipper web material to the outside of folded semi-rigid containers 12. However, such zipper material can be attached to the inside of the semi-rigid containers 12. In such an embodiment, the edges 30, 32 of gussets 34, 36 are slit a required distance, and the zipper web material is introduced between the separated upper portions of gussets 34, 36 and attached thereto and to panels 13, 15. Alternatively, as shown in FIG. 6D, panels 13, 15 (as well as gussets 34, 36) are provided with upwardly facing flaps 13', 15' between and to the inside of which zipper web material forming header 18 is attached as in FIG. 3C.

The web material 102 in the inter-package gaps is then severed by cutting station 120, resulting in the flat and unfilled packages 10 of FIG. 3A. Alternately, in lieu of cutting, perforations can be made in the cross-seals by station 120, thereby leaving the packages in a concatenated chain.

Figure 8B:
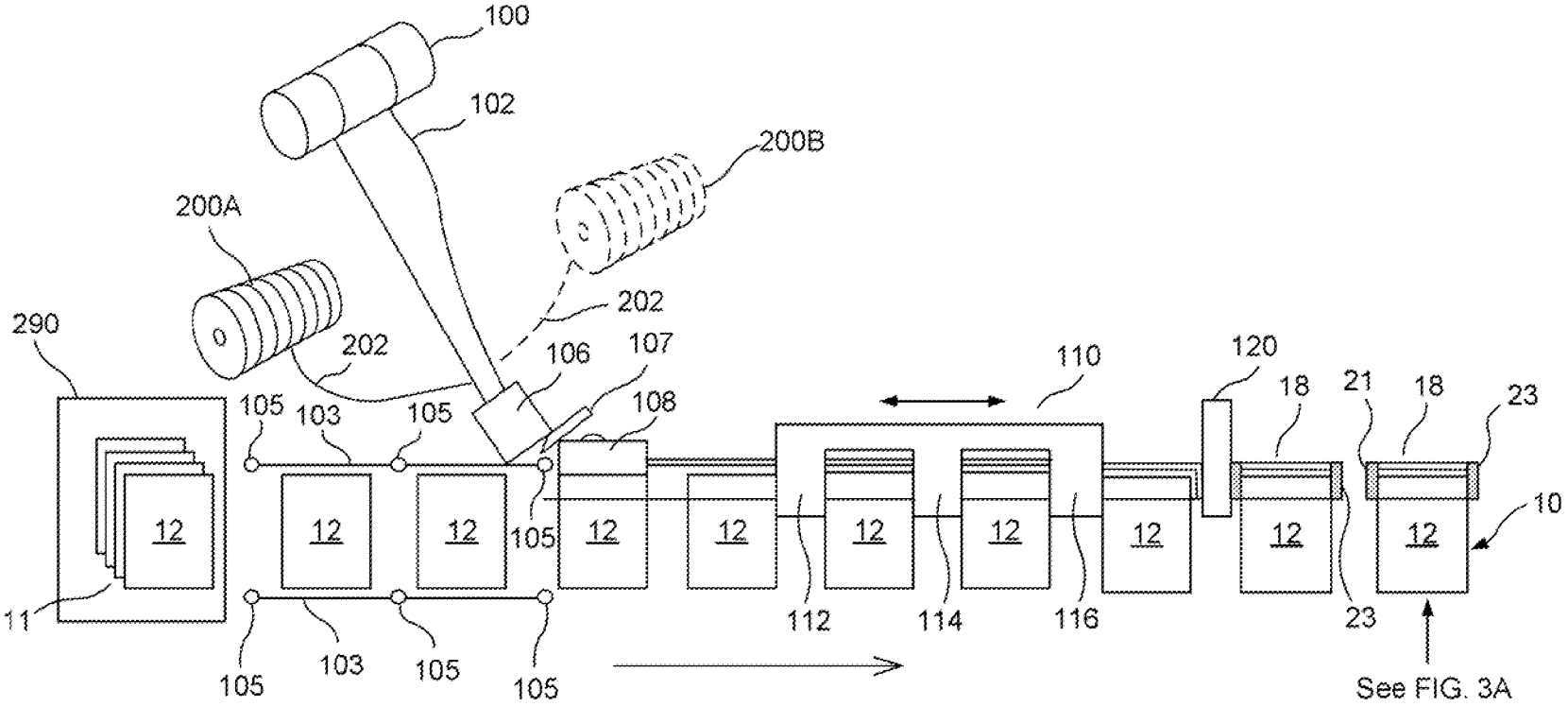
FIG. 8B is a schematic view of a second embodiment of a method and apparatus for producing the package of the present disclosure prior to filling, further including a portion in phantom for illustrating a still further variation.
Figure 8C:
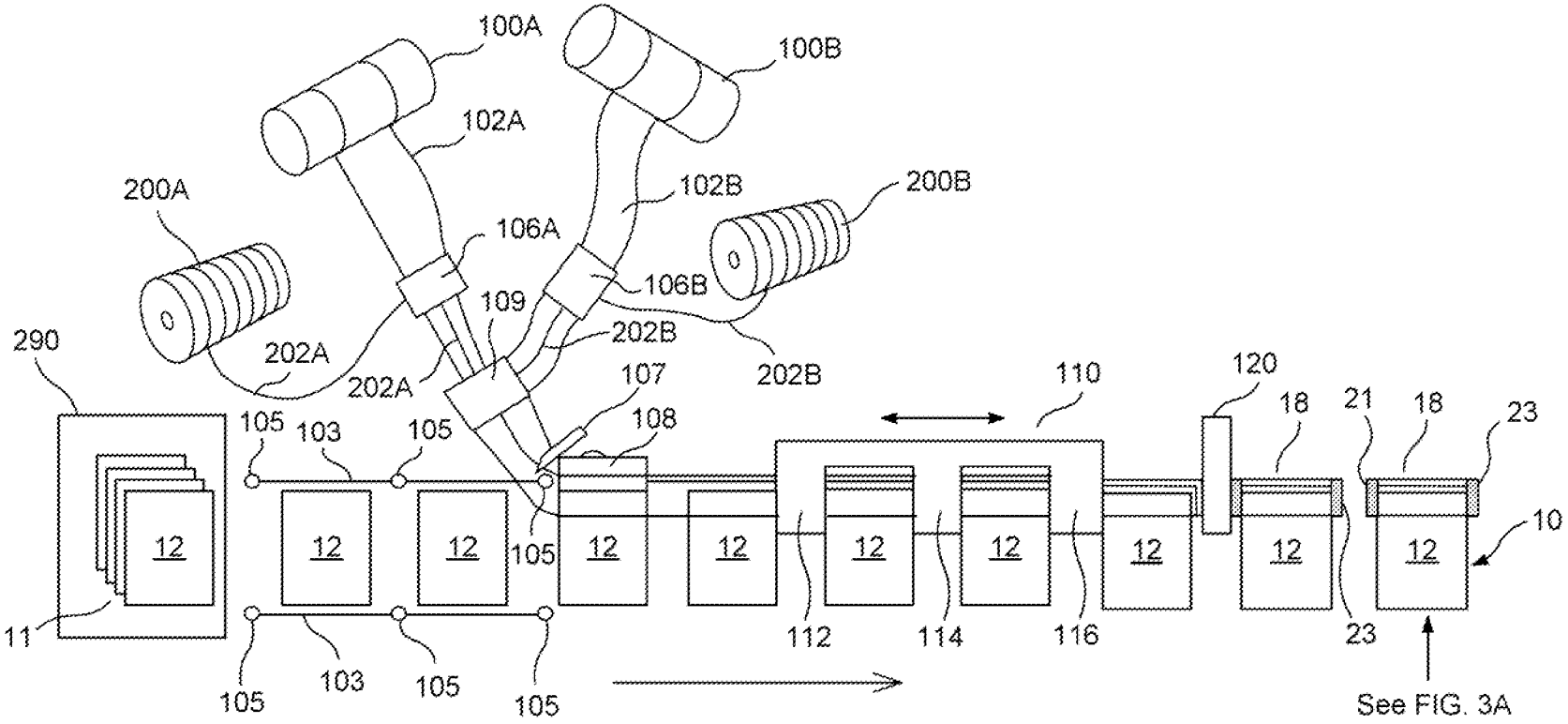
FIG. 8C is a schematic view of a third embodiment of a method and apparatus for producing the package of the present disclosure prior to filling.

FIG. 8B shows a similar method and apparatus, wherein no eyemarks are provided on the web material 102 (typically because no graphics are provided on the web material 102 which would require critical registration) and wherein the conveyor 103 is a servo-driven chain with periodically spaced adjustable lugs 105 for engaging the trailing edges of semi-rigid containers 12 thereby assuring accurate spacing of the semi-rigid containers 12. Further illustrated in FIG. 8B, in phantom, is a second source of zipper material 200B, wherein source 200 would include a first interlockable profile and source 200B would include a second interlockable profile. The separate, unlocked profiles of zipper material 202 may be attached to the web material 102 and the web material 102 thereafter folded so that the profiles of zipper material 202 are aligned and interlocked As shown in FIG. 8C, another alternative is to provide two separate sheets of web 102A, 102B. Zipper profiles 202A, 202B are supplied from respective spools 200A, 200B and sealed to sheets of web 102A, 102B by sealing stations 106A, 106B. The zipper profiles 202A and 202B are then aligned and joined together and the top edges of the sheet web 102A, 102B sealed together at a joining and sealing station 109. However, if at a later stage, the then-formed container is to be filled through the zipper, the top edges 102A and 102B are left unsealed.

Figure 8D:
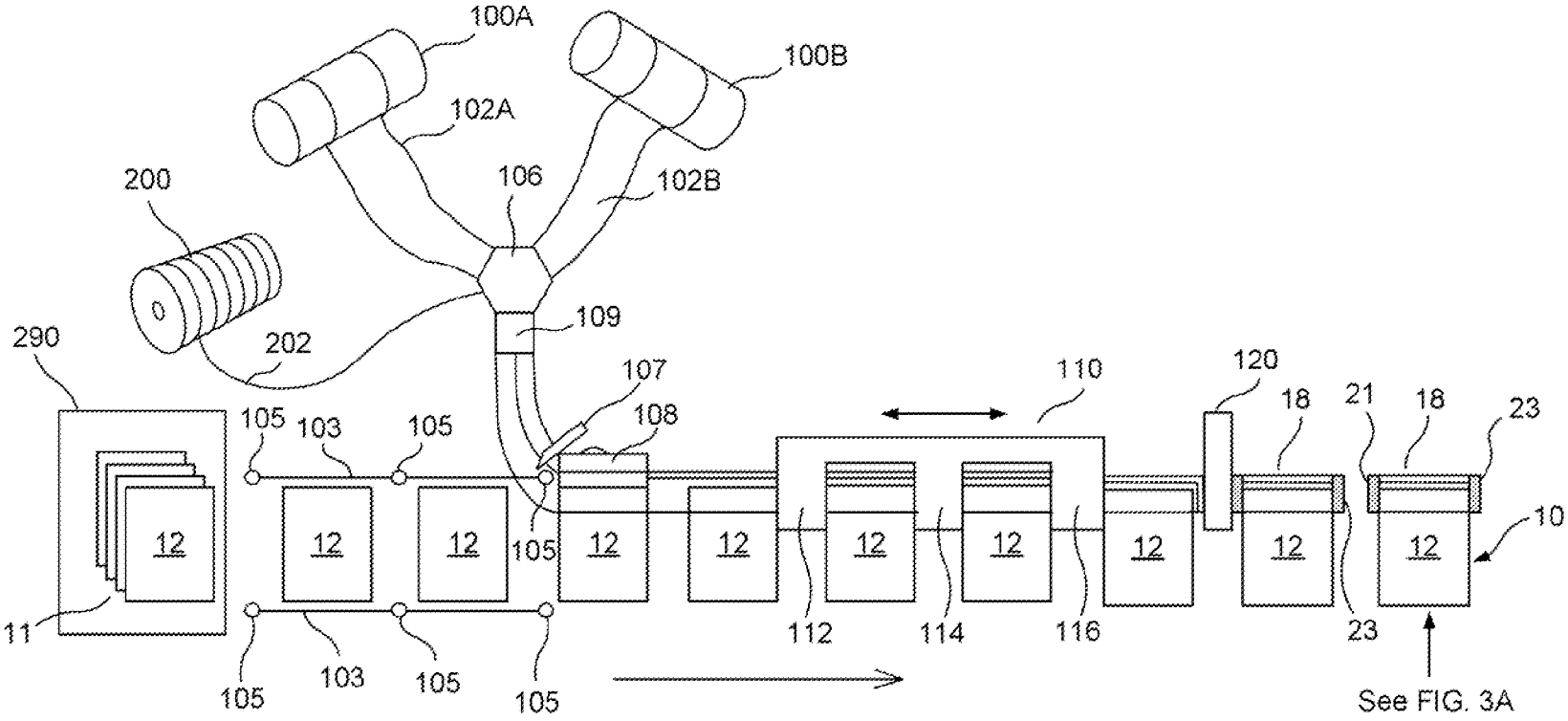
FIG. 8D is a schematic view of a fourth embodiment of a method and apparatus for producing the package of the present disclosure prior to filling.

As shown in FIG. 8D, another alternative is to feed two sheets of web 102A, 102B and interlocked zipper 202 to sealing station 106 wherein a first profile of zipper 202 is sealed to web 102A and a second profile is sealed to web 102B simultaneously or at a later station. Again, however, if at a later stage, the then-formed container is to be filled through the zipper, the top edges 102A, 102B are left unsealed. The top edges of sheets of web 102A, 102B are then sealed together at sealing station 109. FIG. 27H is a representative cross section of what may be produced by this method and apparatus, showing, in particular, lines of weakness 72 or similar opening structure (which may include perforations, laser scored lines, tear beads, tear notches, linear tear lines, a peel seal, or similar structures, and may be configured as multiple lines) formed in sidewalls 20, 22 thereby providing access to zipper 24 after removal of removable header portion 29. Further illustrated in FIG. 27H is pocket 133 formed between seals 135, 137 that can hold printed advertising or similar material 138 therein. This structure is likewise illustrated in FIG. 22.

Figure 8E:
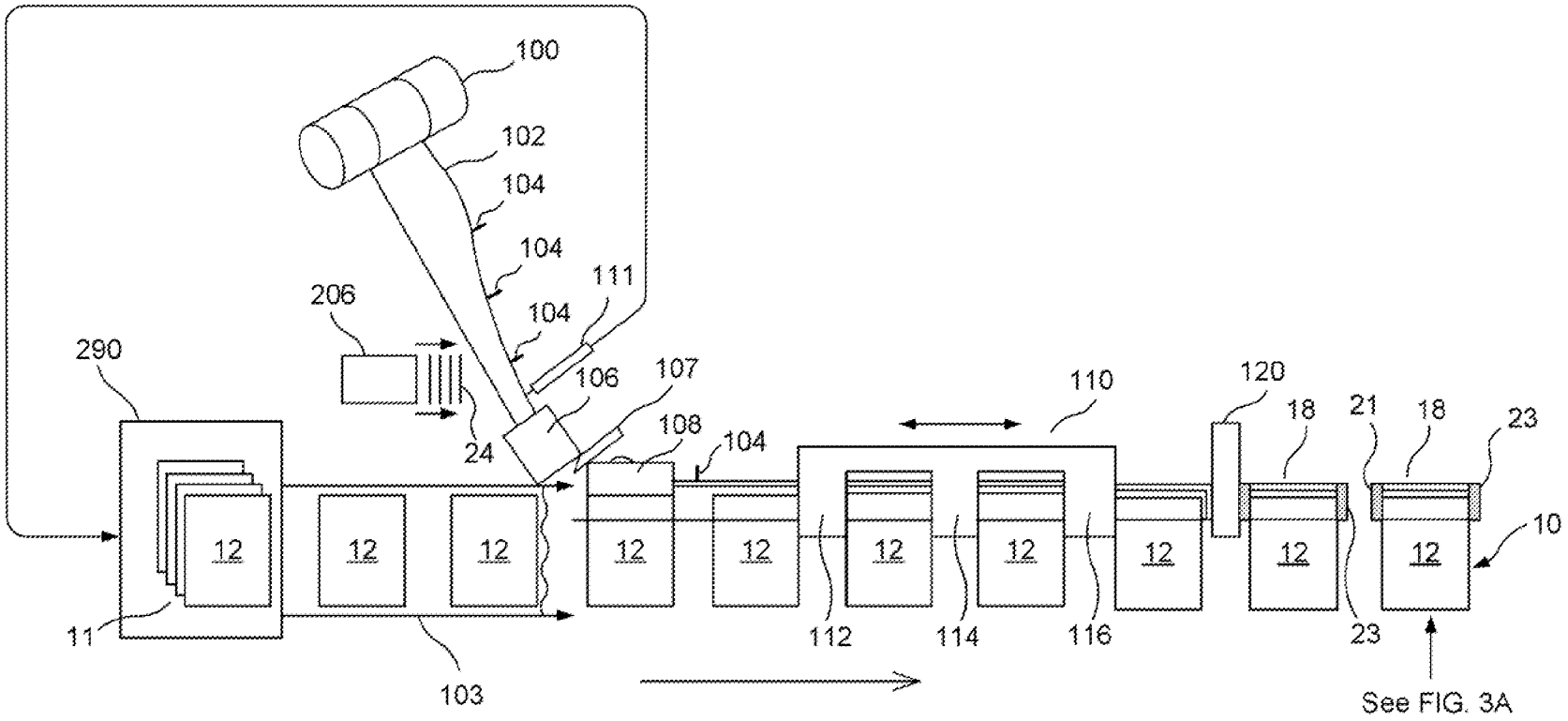
FIG. 8E is a schematic view of a fifth embodiment of a method and apparatus for producing the package of the present disclosure prior to filling.
Figure 17A:
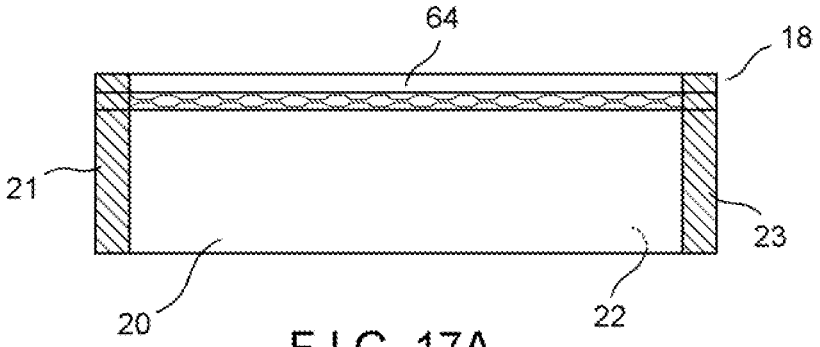
FIG. 17A is a plan view of a header of an embodiment of the package of the present disclosure, wherein the header is opened by way of a pre-activated peel seal.
Figure 17B:
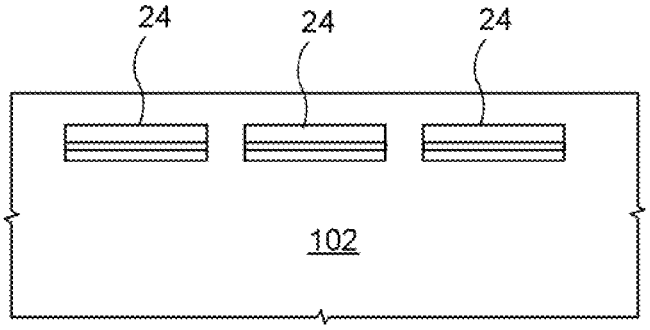
FIG. 17B is a plan view of discrete zipper segments on a length of web material.

As shown in FIG. 8E, segments of zipper material, resulting in discrete zippers 24, may be fed to the length of web material 102 by zipper feeder 206 as shown in FIG. 17B resulting in a spaced-apart configuration. This may avoid having the zipper profile in cross-seals 21, 23, but requires accurate registration of the zippers 24 with respect to the web material 102. In this embodiment, the zipper segments may be applied to web material 102 in line with the web direction or at an angle to it.

Figure 8F:
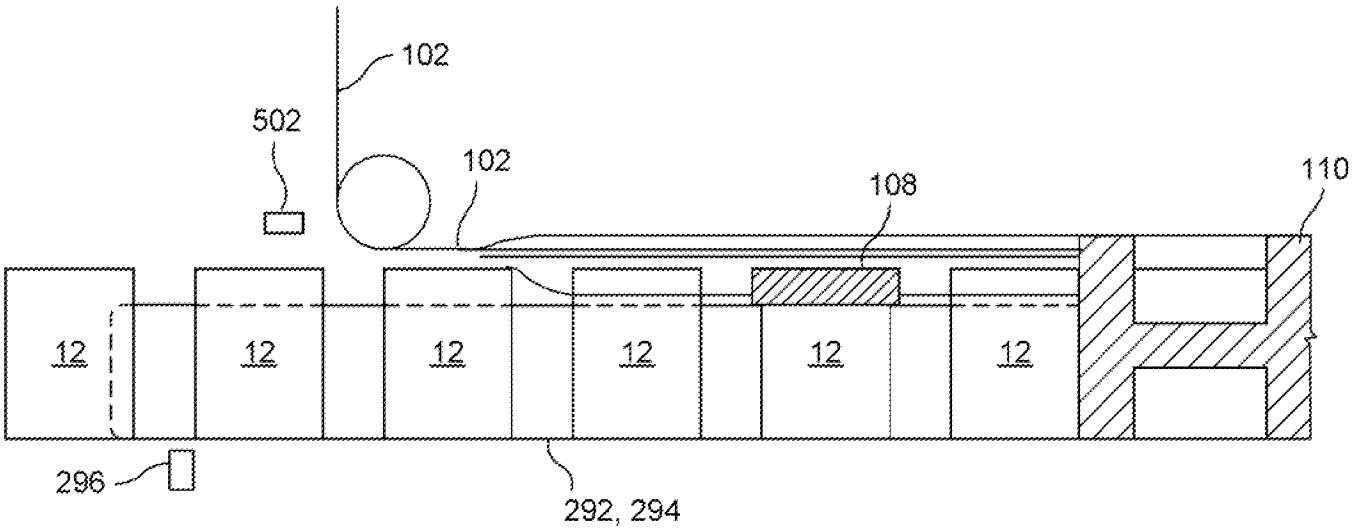
FIG. 8F is a schematic of view of a sixth embodiment of a method and apparatus for producing the package of the present disclosure prior to filling.
Figure 8G:
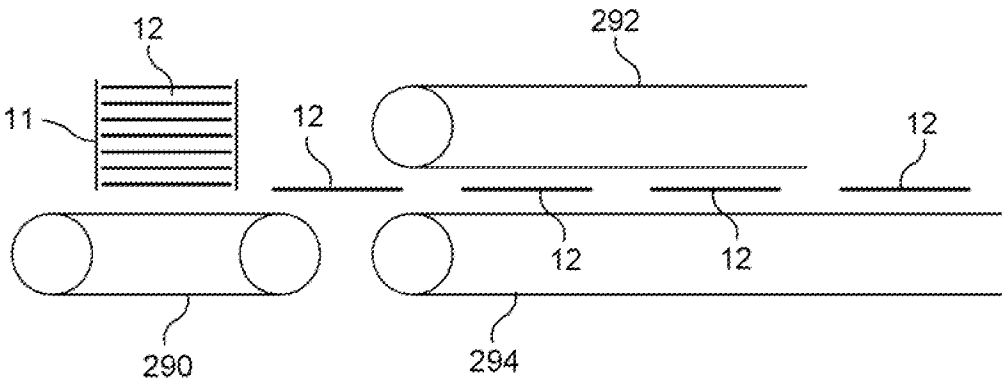
FIG. 8G is a side view of the sixth embodiment (see FIG. 8F) of a method and apparatus for producing the package of the present disclosure prior to filling.

As shown in FIGS. 8F and 8G, stack 11 is implemented as a magazine with containers 12 stacked vertically therein. Sequential feeder 290 is implemented as a conveyor belt. Conveyor belt 290 pulls a single container 12 through a feed gate which allows only the thickness of one box to pass through. Containers 12 are then engaged in a nip formed between upper and lower conveyor pull belts 292, 294. The upper and lower conveyor pull belts 292, 294 are typically set at a speed different than that of the conveyor belt 290 in order to control the gap between successive containers 12. The edge of containers 12 is sensed by electric eye 296 which controls the operation of glue dot applicator 502 (similar to that shown in FIG. 9C) which applies glue dots to the containers 12.

Figure 9A:
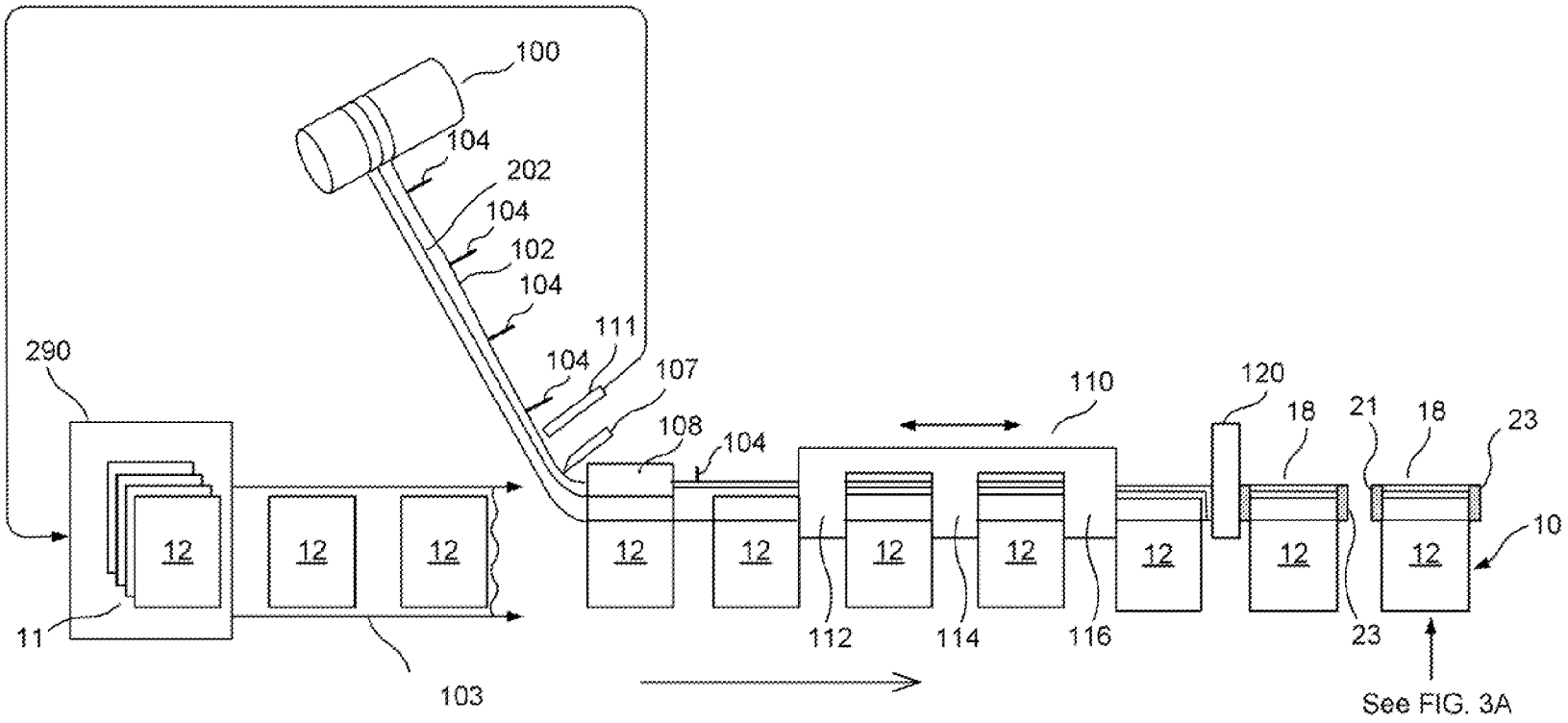
FIG. 9A is a schematic view of a seventh embodiment of a method and apparatus for producing the package of the present disclosure prior to filling.
Figure 9B:
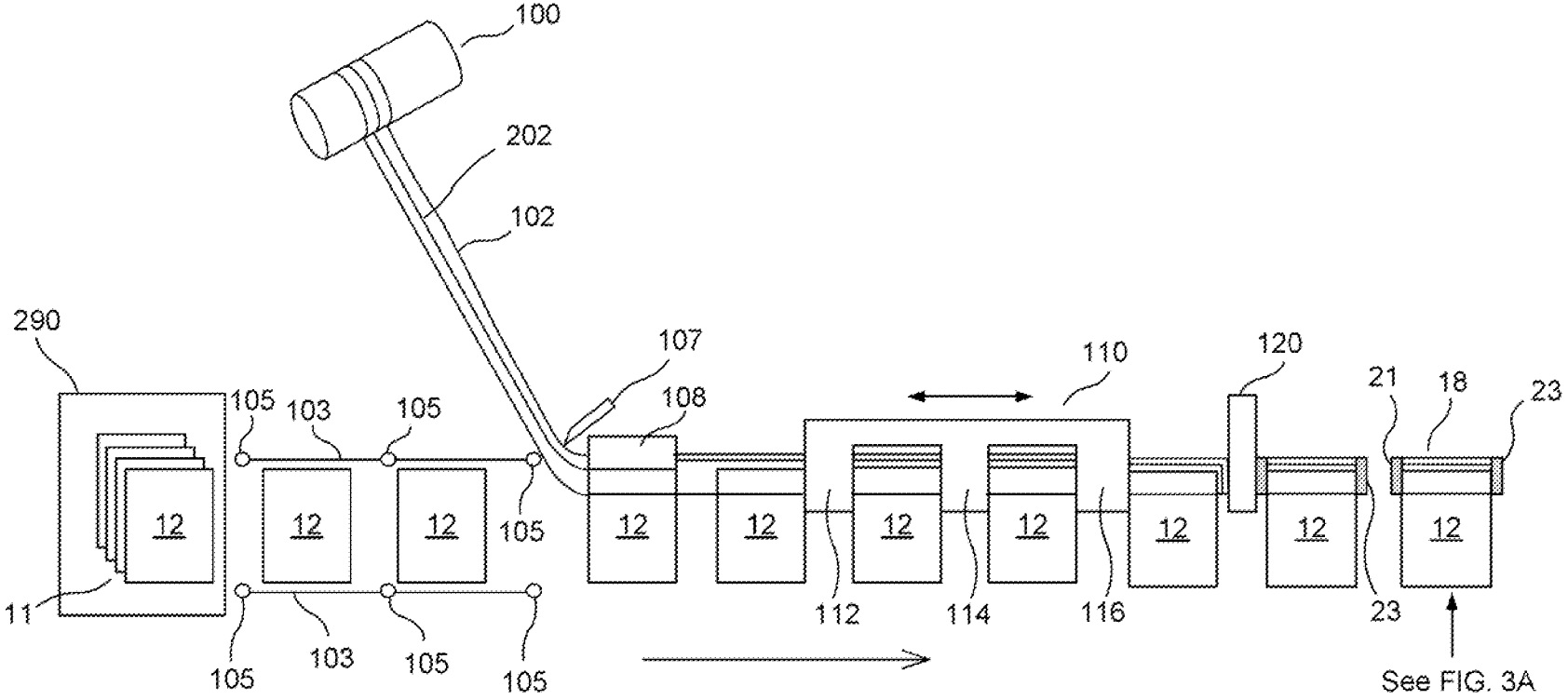
FIG. 9B is a schematic view of an eighth embodiment of a method and apparatus for producing the package of the present disclosure prior to filling.
Figure 10:
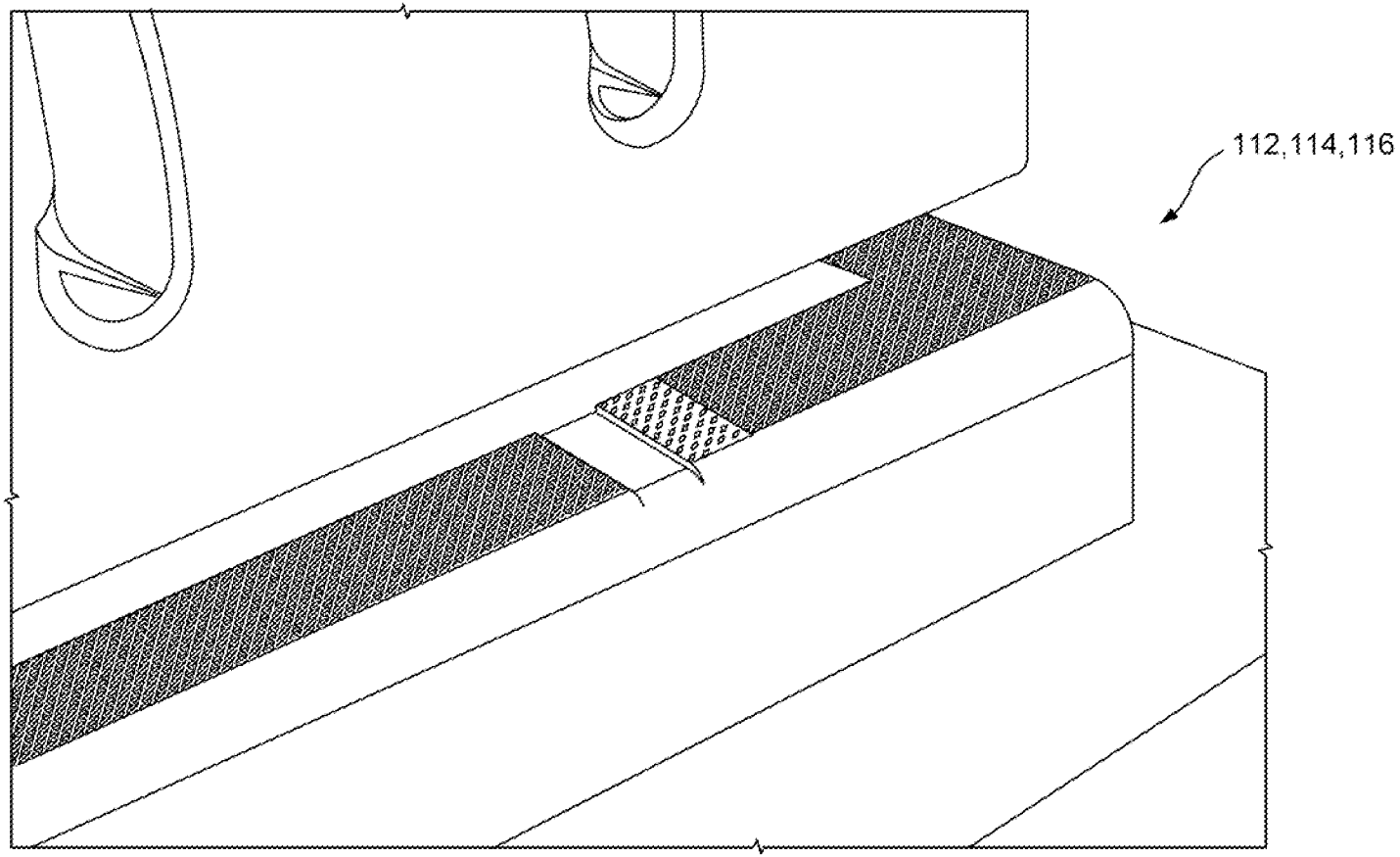
FIG. 10 is a perspective view of an embodiment of the ultrasonic apparatus used to form the cross-seals in an aspect of an embodiment of the method and apparatus for producing the package.
Figure 11:
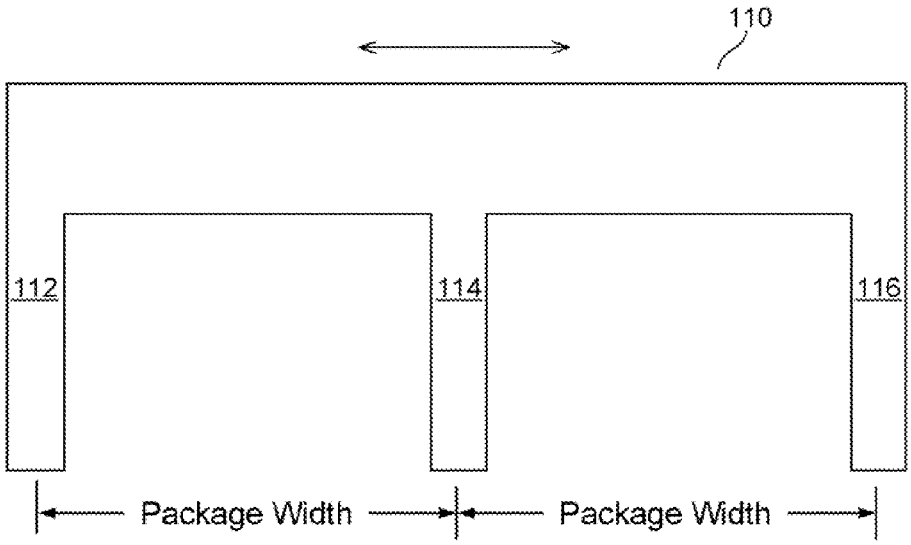
FIG. 11 is a perspective view of an ultrasonic apparatus used to form three cross-seals simultaneously in an aspect of an embodiment of the method and apparatus for producing the package.

FIGS. 9A and 9B disclose methods and apparatus similar to those of FIGS. 8A and 8B, except that web material 102 is supplied with the length of zipper material 202 already sealed thereto. If the web material 102 is provided in a folded state, then folding within the illustrated apparatus is not required.

Figure 9C:
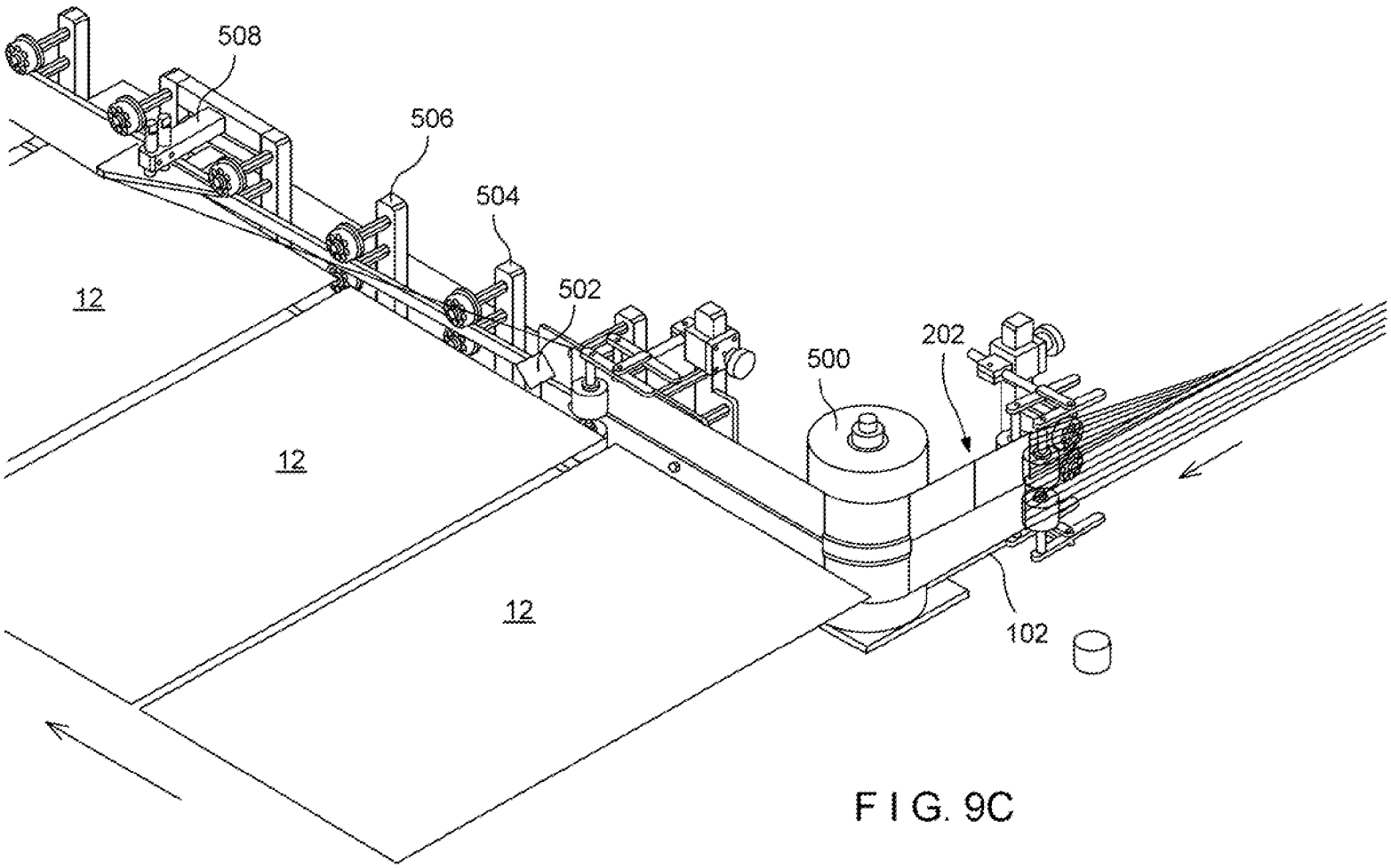
FIG. 9C is a schematic view of a ninth embodiment of a method and apparatus for producing the package of the present disclosure prior to filling.

FIG. 9C discloses a method and apparatus wherein the length of web material 102 is supplied with the length of zipper 202 already attached thereto. The length of web material 102 is fed in open configuration at a right angle (i.e., perpendicularly) to the direction of travel of the semi-rigid containers 12. The length of web material 102 (with zipper 202 attached) is then brought into alignment with the direction of travel of semi-rigid containers by roller 500. Glue spots are applied by applicator 502 and guiding rollers 504, 506, 508 fold the web material 102 over the succession of semi-rigid containers 12.

Typically, the resulting header 18 comprises web reclosure material, wherein the distance between the edges of the header 18, when spread apart, is greater than the distance between the edges of the sides of the semi-rigid container 12 when the semi-rigid container 12 is unfolded and formed (i.e., the distance between first and second front interior vertical folds 38, 40).

Figure 27A:
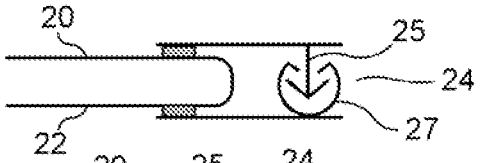
FIGS. 27A-27I illustrate various zipper and web material cross sections which may be used in embodiments of the present disclosure.
Figure 27B:
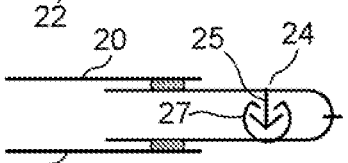
Figure 27C:
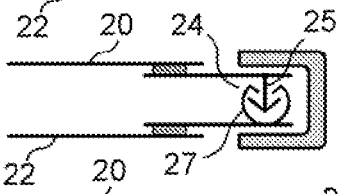
Figure 27D:
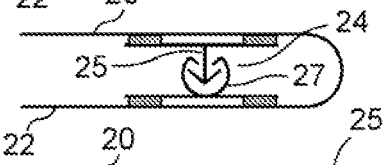
Figure 27E:
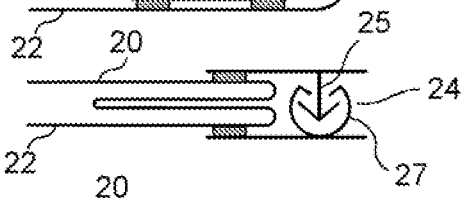
Figure 27F:
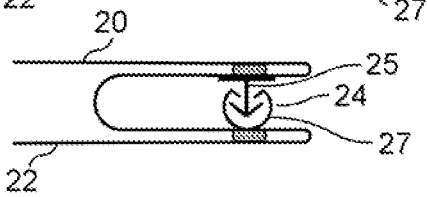
Figure 27G:
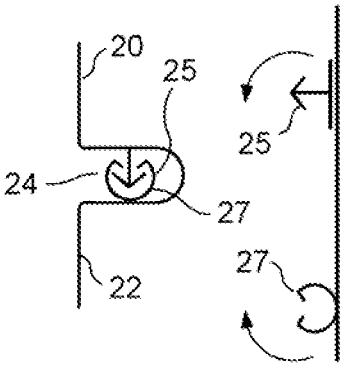
Figure 27H:
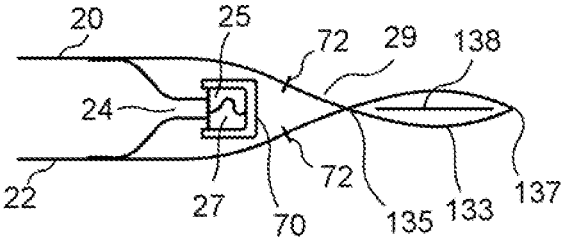
Figure 27I:
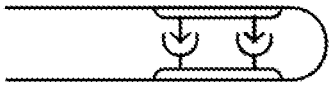

FIGS. 27A-27I illustrate various embodiments or variations of the zipper 24, including profiles 25, 27, with respect to their attachment to front and rear sidewalls 20, 22 of web material 102, as well as different configurations of web material 102 as in FIGS. 27E and 27F. It should be noted that FIGS. 27A, 27E and 27F relate to constructions where the zipper is attached to the outside of the folded web material (also see FIGS. 6E and 6G). As stated previously, many different kinds of zippers can be used, such as hinged zippers, slider zippers, flangeless (string) zippers and any of the zippers disclosed in U.S. Pat. No. 6,360,513 entitled "Resealable Bag for Filling with Food Product(s) and Method", to Strand et al.; U.S. Pat. No. 7,137,736 entitled "Closure Device for a Reclosable Pouch" to Pawloski; U.S. Pat. No. 5,972,396 entitled "Flexible Package Having a Reclosable Zipper" to Jurgovan; U.S. Pat. No. 6,030,122 entitled "Pinch-Grip Zipper" to Ramsey; U.S. Pat. No. 6,347,885 entitled "Reclosable Package Having Zipper Closure, Slider Device and Tamper-Evident Structure" to Buchman; U.S. Pat. No. 6,427,421 entitled "Method of Manufacturing Recloseable Packages" to Belmont; U.S. Pat. No. 4,846,585 entitled "Easy Open Bag Structure" to Boeckmann; U.S. Pat. No. 4,874,257 entitled "Method of Forming a Closed Filled Bag, a Bag Construction and an Apparatus for Forming the Bag" to Inagaki; U.S. Pat. No. 6,299,353 entitled "Zipper for Reclosable Container with Apertures Passing Through Female Profile" to Piechocki; U.S. Pat. No. 6,955,465 entitled "Powder-Resistant Flexible Zipper For Reclosable Packaging" to Machacek; U.S. Pat. No. 7,241,046 entitled "Watertight Closure for a Reclosable Package" to Piechocki; U.S. Pat. No. 6,609,827 entitled "Bag Having Slider-Actuated Complementary Closure Strips and a Leakproofing Structure" to Bois et al.; U.S. Pat. No. 3,325,084 entitled "Pressure Closable Fastener" to Ausnit; U.S. Pat. No. Re. 34,554 entitled "Bags with Reclosable Plastic Fastener Having Automatic Sealing Gasket Means" to Ausnit; U.S. Pat. No. 5,520,463 entitled "Foamed Zipper" to Tilman; U.S. Pat. No. 4,787,880 entitled "Method of Making Extruded Zipper Strips and Bags Containing the Same" to Ausnit; U.S. Pat. No. 6,177,172 entitled "Zippered Film and Bag" to Yeager; U.S. Pat. No. 6,021,557 entitled "Process of Making a Zipper for a Reclosable Thermoplastic Bag" to Dais et al.; U.S. Pat. No. 7,478,950 entitled "Variable Alignment Slider Zipper for Reclosable Bags" to Plourde et al.; U.S. Pat. No. 4,925,316 entitled "Reclosable Bag Having an Outer Reclosable Zipper Type Closure and Inner Non-Reclosable Closure" to Van Erden et al.; U.S. Pat. No. 4,923,309 entitled "Tamper-Evident Package" to Van Erden; U.S. Pat. No. 5,509,734 entitled "Wedge Activated Zipper" to Ausnit; U.S. Pat. No. 4,736,451 entitled "Extruded Zipper Having Combination Stabilizing and Differential Opening Means" to Ausnit; U.S. Pat. No. 5,412,924 entitled "Method of Making Reclosable Plastic Bags on a Form, Fill and Seal Machine" to Ausnit; U.S. Pat. No. 3,959,856 entitled "Interlocking Separable Fastener" to Ausnit; U.S. Pat. No. 6,131,370 entitled "Zipper Applied Across a Film in Transverse Direction" to Ausnit; U.S. Pat. No. 6,863,754 entitled "Apparatus and Method for Manufacturing Reclosable Bags Utilizing Zipper Tape Material" to Wright et al.; U.S. Pat. No. 6,290,392 entitled "Reclosable Plastic Bag with Deformable, Stay-Open Inlay" to Sandor; U.S. Pat. No. 3,054,434 entitled "Bag Closure" to Ausnit; U.S. Pat. No. 4,665,552 entitled "Zipper Equipped Bags and Method of and Means for Manually Filling and Separating Them" to Lems et al.; U.S. Pat. No. 5,902,427 entitled "Fastener Arrangement with Dual Purpose Cover Sheet" to Zinke et al.; U.S. Pat. No. 5,174,658 entitled "Self-Expanding and Reclosable Flexible Pouch" to Cook et al.; U.S. Pat. No. 6,827,491 entitled "Wide Open Feature for Reclosable Bags" to Kohl et al.; U.S. Pat. No. 6,899,460 entitled "Storage Bag with Openly Biased Mouth" to Turvey et al.; and U.S. Pat. No. 6,167,597 entitled "High Compression Zipper" to Malin, the contents of all of which are hereby incorporated by reference in their entirety.

Figure 12:
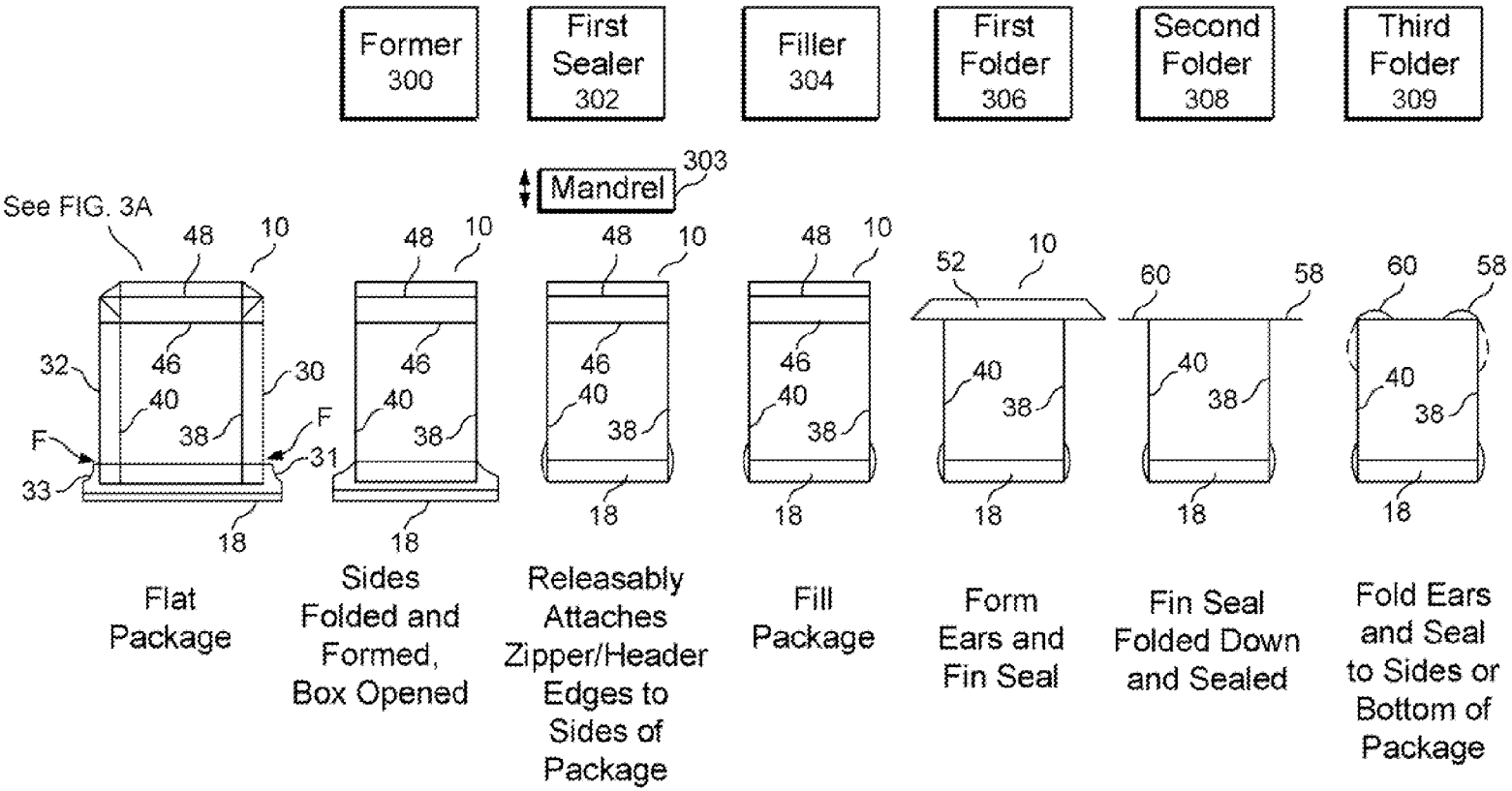
FIG. 12 is a schematic of an embodiment of method and apparatus of the present disclosure for bottom filling and sealing the packages.
Figure 13:
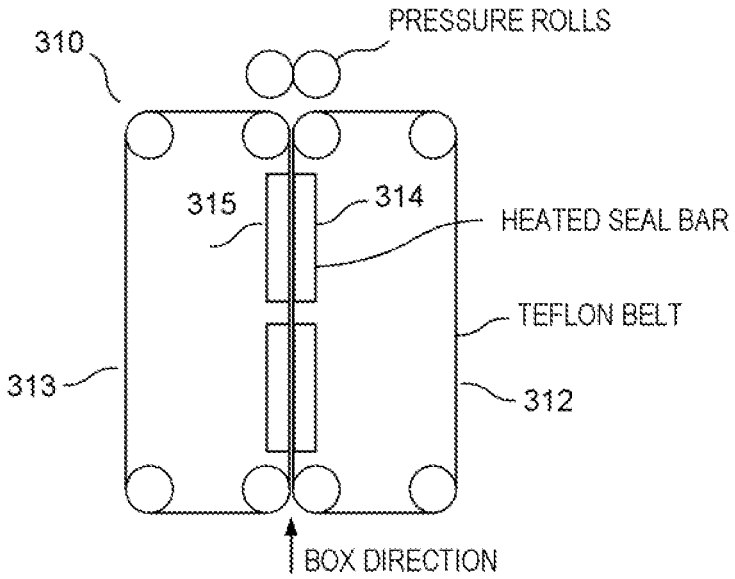
FIG. 13 is a top view of a band sealer used for forming the bottom fin seal in an aspect of an embodiment of the method and apparatus of the present disclosure.
Figure 14:
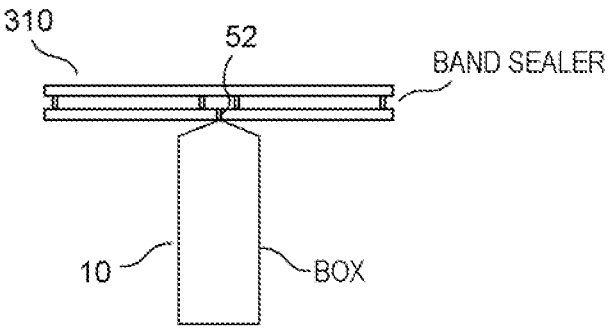
FIG. 14 is a side view of the band sealer of FIG. 13 forming a bottom fin seal for an inverted package in an aspect of an embodiment of the method and apparatus of the present disclosure.

A typical bottom filling method and apparatus is shown in FIG. 12. It is important to note that the filling apparatus and machinery shown in FIG. 12 may be geographically or otherwise spatially separated from the package forming machinery of FIGS. 8A-G and 9A-C. The forming and filling operations may take place at separate times and places, at the same time and place. The forming and filling apparatus and machinery may be on separate manufacturing lines or on an integrated manufacturing line. The package of FIG. 3A (resulting from the method and apparatus of one of FIGS. 8A-G and FIGS. 9A-C) is inverted. Former 300 opens up the package 10 so that first and second interior vertical folds 38, 38', 40, 40' become the corners of the semi-rigid container 12, and a product volume is created within the semi-rigid container 12. This typically includes applying opposing forces on the semi-rigid container 12 near cross seals 21, 23 as illustrated by the arrows labeled "F" on the far left of FIG. 12. At first sealer 302 (alternatively characterized as a releasable attacher), as explained with respect to FIG. 3A, first and second oval-shaped dots of glue 51, 53 are placed on one side of front of header 18 and the header 18 is folded so that first and second oval-shaped dots of glue 51, 53 cover and are glued or otherwise secured to respective first and second oval-shaped partially scored portions 47, 49. Mandrel 303, which may be reciprocating, may be used in combination with first sealer 302 to assure a square shape of the semi-rigid container 12 and further to assure reliable gluing by dots 51, 53. Alternately, other methods of attaching header 18 to the sides of the formed semi-rigid container 12 may be used as previous described. Thereafter, inverted package 10 is filled from filler 304. First folder 306 folds along first and second interior horizontal folds 46, 46', 48 and seals to form fin seal 52 and triangular ears 58, 60 as shown in FIGS. 4A and 4B. First folder 306 may be implemented as an inverted configuration of the band sealer 310 shown in FIGS. 13 and 14. Polytetrafluoroethylene belts 312, 313 grip the material of the fin seal 52 and heated seal bars 314, 315 perform the sealing operation between the front and rear panels 13, 15 thereby completing the fin seal 52. First folder 306 may also utilize adhesive for closing the bottom of the package 10. Second folder 308 folds the fin seal 52 flush to the package 10 and seals the fin seal 52 to the package 10. Third folder 309 seals triangular ears 58, 60 to the bottom of the package 10 (shown in solid) or to the first and second gusseted sides 34, 36 of semi-rigid container 12 (shown in phantom). It may be preferred that the triangular ears 58, 60 be sealed to the bottom of the package 10 for aesthetic purposes and to reduce the possibility of the consumer opening the bottom of the package 10. The semi-rigid container 12 may have different bottom folding sections and different ways of folding these sections. In alternative embodiments, the packages 10 are filled at a later stage, or are maintained in a continuous chain with perforated lines attaching the cross seals between adjacent packages 10 and stacked in a zig-zag configuration. In another alternative, the semi-rigid container 12 is not inverted. After the bottom of the container is formed, the semi-rigid container 12 is filled through the top as described hereinafter with respect to FIGS. 21A-C.

Figure 15A:
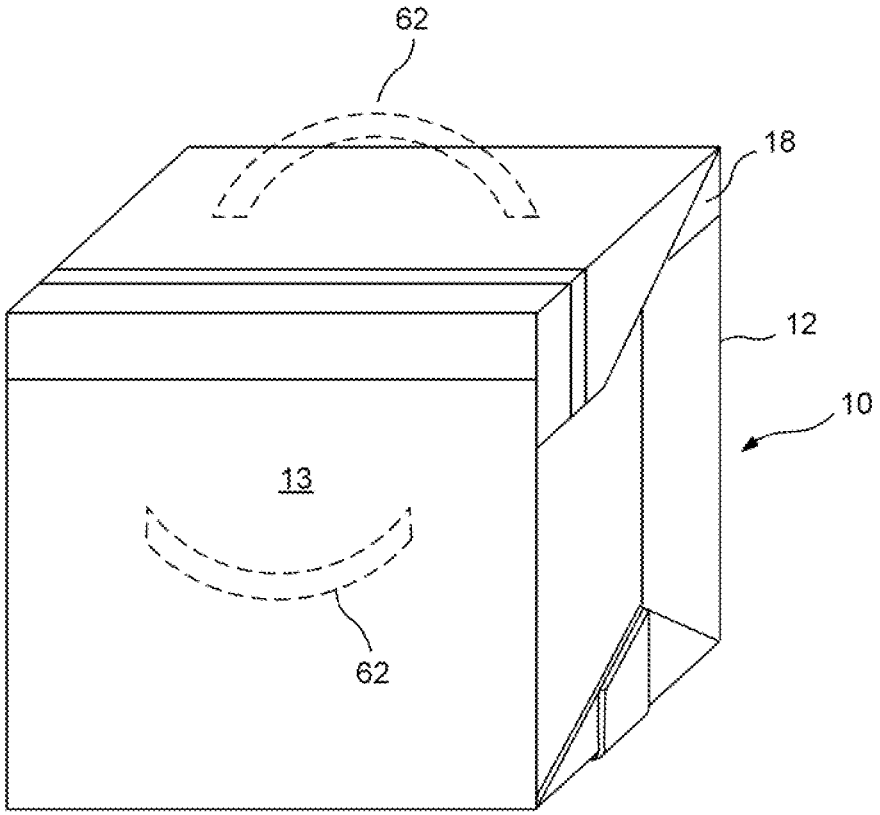
FIG. 15A is a plan view of an embodiment of the package of the present disclosure, showing two alternative handle positions.

FIG. 15A illustrates, in phantom, two possible positions of an optional handle 62 or 62'. One handle 62 may be sealed or otherwise formed on the side of header 18. Alternatively, a handle 62' may be sealed or otherwise formed on front panel 13 of package 10.

Figure 15B:
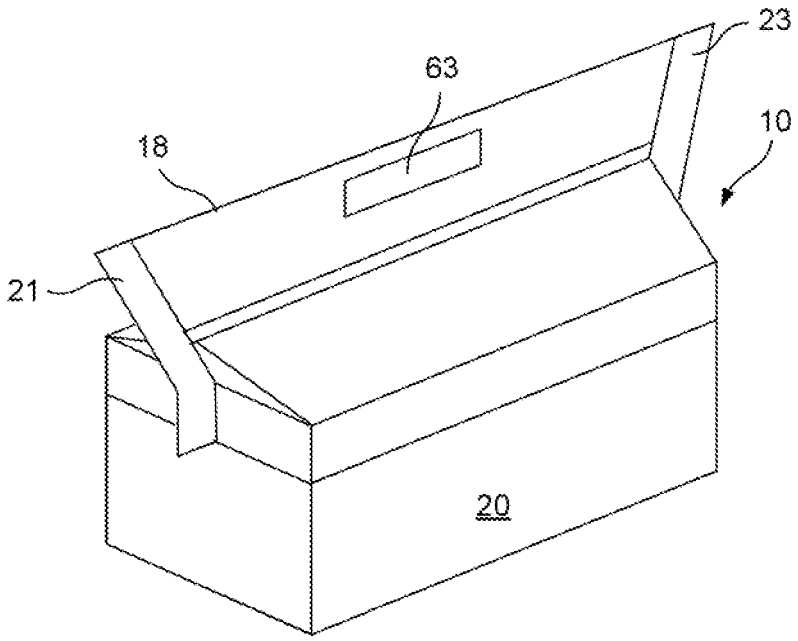
FIG. 15B is a perspective view of an embodiment of the package of the present disclosure, showing a handle built into the header.

FIG. 15B illustrates, in perspective, an extended header 18 with an aperture 63 therethrough, thereby forming a handle.

Figure 16:
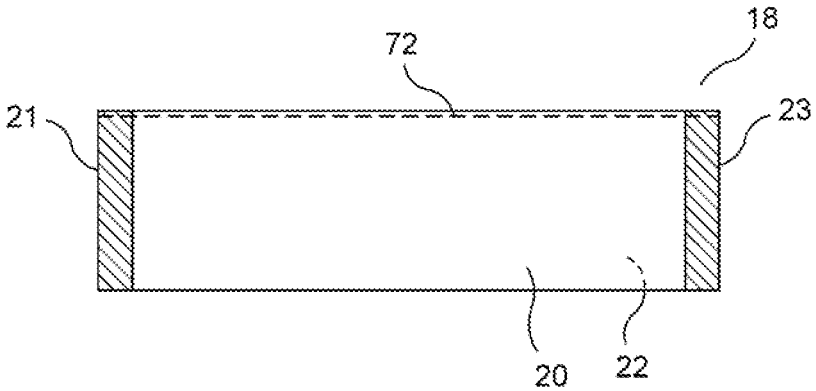
FIG. 16 is a plan view of a header of an embodiment of the package of the present disclosure, wherein the header is opened by a perforated line or similar line of weakness.

FIG. 16 illustrates an embodiment of header 18 wherein the fold between the first and second sidewalls 20, 22 of header 18 includes a line of weakness 72 (which may include perforations, laser scored lines, tear beads, tear notches, linear tear films, or similar structures, and may be configured as multiple lines) in place of, or in conjunction with, closure 24. Similarly, element 72 may be implemented as a linear tear line. This provides for a header 18 which can be opened by the consumer, but not reclosed. Similarly, FIG. 17A illustrates an embodiment of header 18 wherein sidewalls 20, 22 are provided as separate pieces with a peel seal 64 (typically pre-activated) therebetween. Element 64 could likewise be implemented as a tear tape or a pinch-grip zipper.

Figure 18:
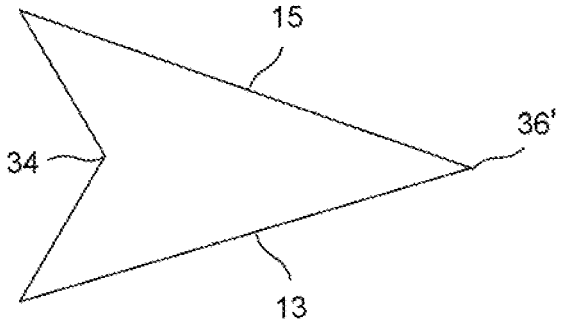
FIG. 18 is a top plan view of a triangular rigid or semi-rigid portion of an embodiment of the package of the present disclosure, thereby allowing for improved pouring from the package in some instances.

FIG. 18 illustrates a cross-section of an embodiment of semi-rigid container 12 wherein front and rear panels 13, 15 are joined at one end by first gusseted side 34 and directly joined to each other at the other end at point 36' thereby eliminating second gusseted side 36 and providing a triangular cross section which may be advantageous for pouring.

Figure 19A:
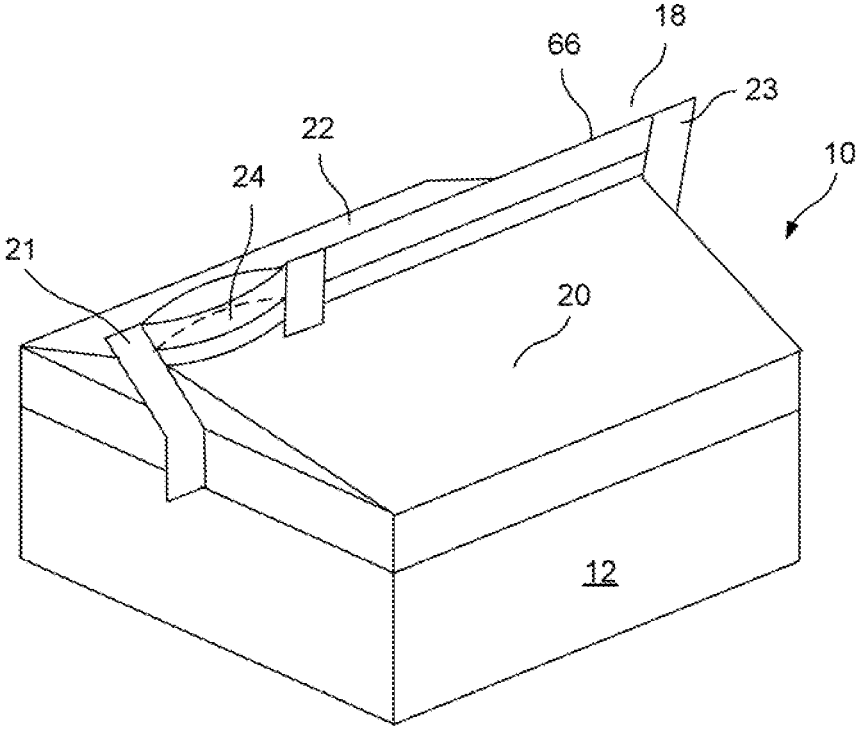
FIG. 19A is a perspective view of a header of an embodiment of the package of the present disclosure, wherein the zipper extends only partially across the top of the header.
Figure 19B:
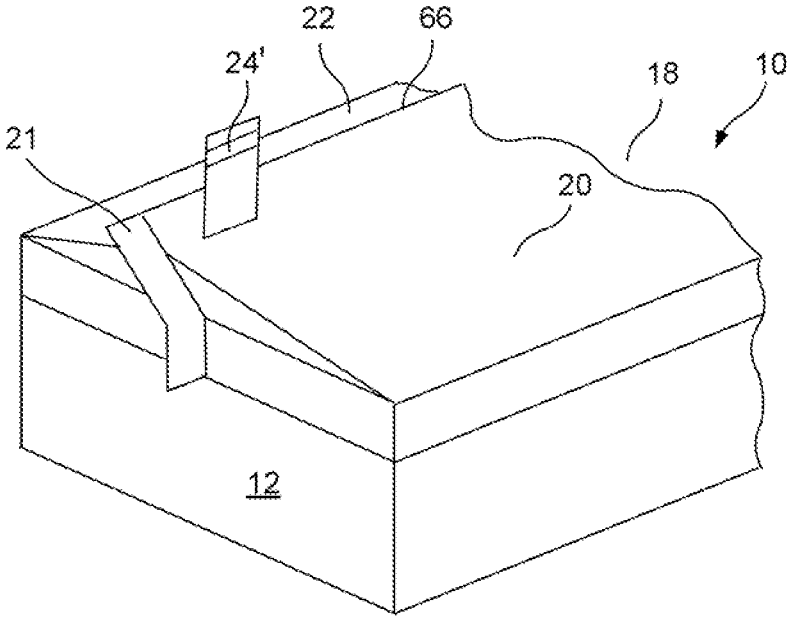
FIG. 19B is a perspective view of a header of an embodiment of the package of the present disclosure, wherein a shortened zipper is provided across a portion of the top of the header.

FIG. 19A illustrates an embodiment of a header 18 wherein first and second sidewalls 20, 22 are sealed or otherwise joined to each other along a portion 66 of the top edge, with a zipper 24, including first and second profiles 25, 27, providing a reclosure along the remainder of the top edge. Typically, portion 66 is formed by sealing together a section of the zipper or the cross-seal 23 is extended across the header 18, leaving only a small section open for pouring out the contents. Similarly, FIG. 19B illustrates an embodiment of header 18 wherein a shortened zipper segment 24', configured as a fitment, is inserted into the seal 66 between first and second sidewalls 20, 22 in a configuration adapted to locking after pouring of contents.

Figure 20:
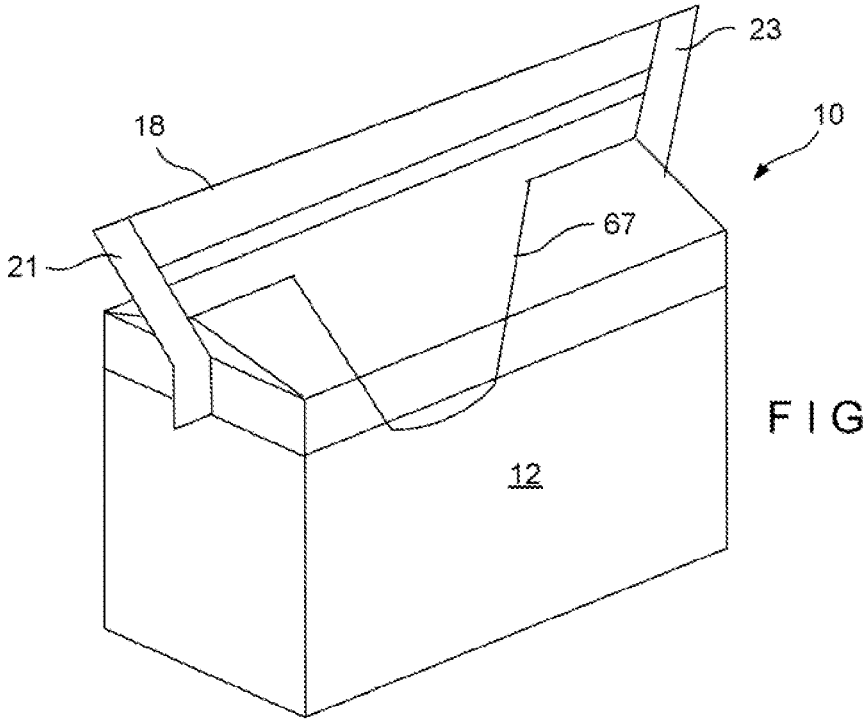
FIG. 20 is a plan view of a header of an embodiment of the package of the present disclosure, showing the zipper providing access to a pour spout.

FIG. 20 illustrates an embodiment of header 18 including a funnel portion 67 created by forming diagonal seals and cut-outs to the double folded zipper film. Access to the funnel portion 67 is provided by zipper 24. The funnel portion 67 would be extended through header 18 for dispensing product therefrom.

Figure 21A:
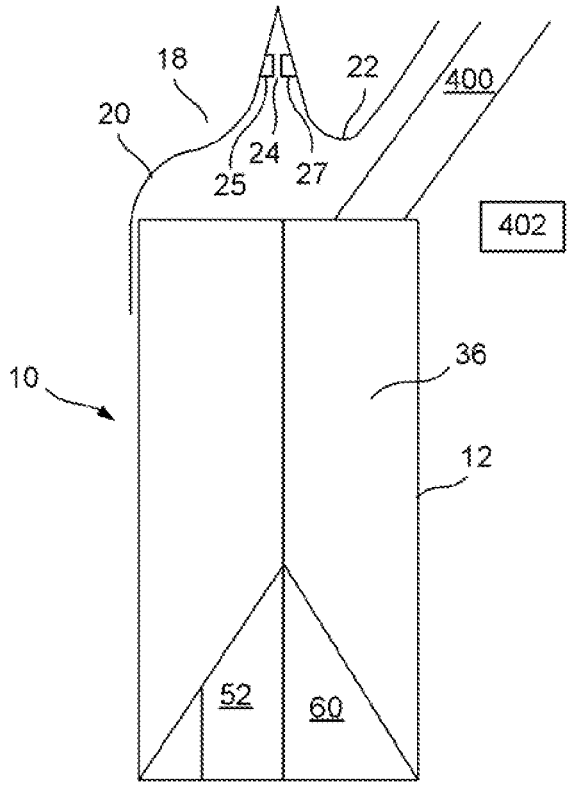
FIG. 21A is a diagram of embodiment of the package of the present disclosure, wherein the package is filled between the container and the web of the header material.
Figure 21B:
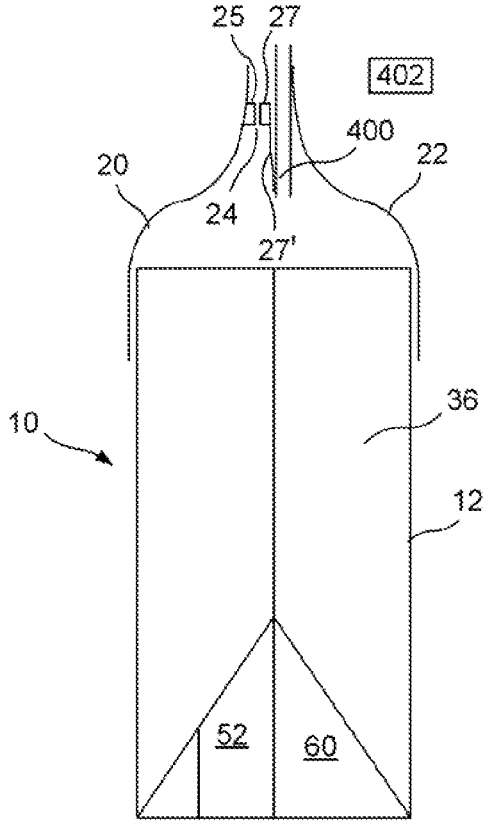
FIG. 21B is a diagram of an embodiment of the package of the present disclosure, wherein the package is filled between the zipper and the header.
Figure 21C:
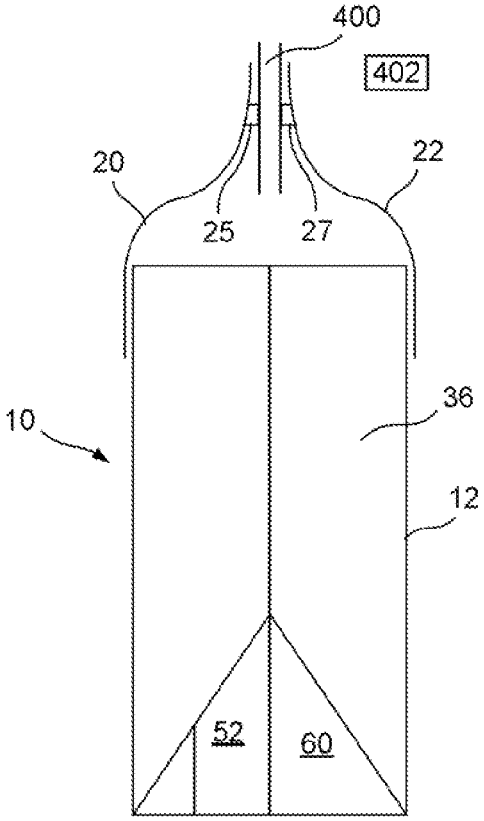
FIG. 21C is a diagram of an embodiment of the package of the present disclosure, wherein the package is filled between the zipper profiles.

FIG. 21A illustrates an embodiment with top-filling, wherein, first sidewall 20 of header 18 is sealed, glued or attached to the semi-rigid container 12. Prior to the sealing, gluing, or other attachment of second sidewall 22 of header 18 to semi-rigid container 12, filling apparatus 400 inserts the contents into the package. Thereafter, the second sidewall 22 is attached or sealed back to semi-rigid container 12 by sealer 402. Alternately, as shown in FIG. 21B, a zipper flange 27' can be left unattached from its corresponding sidewall 22 and the product is filled by filler between the flange 27' and the sidewall 22. Thereafter, the flange 27' and the sidewall 22 are attached together by sealer 402. In a further alternative embodiment shown in FIG. 21C, the top of the film of header 18 is slit, the zipper (or reclosure) 24 is opened, product is filled through zipper 24 by filler 400, the zipper 24 is reclosed and the slit edges of header 18 are resealed by sealer 402. However, if separate sheets of web material are used as in FIG. 8C, there is no need to slit the top of header 18.

Figure 22:
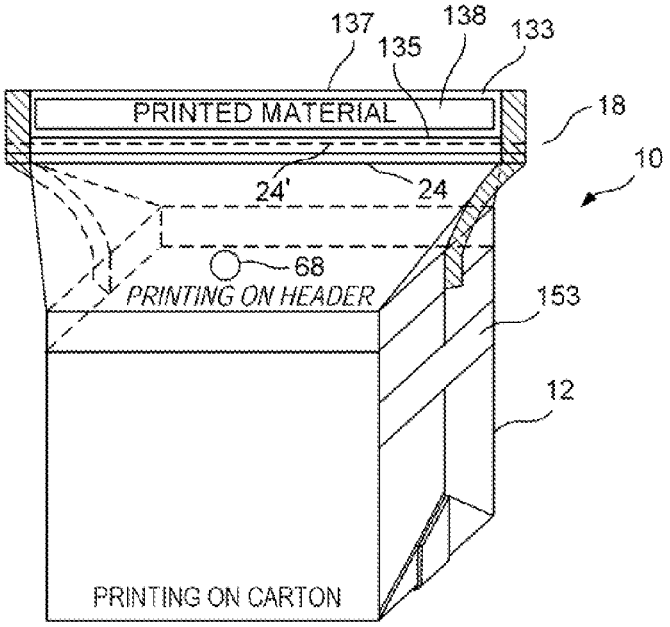
FIG. 22 is a diagram of several variations of an embodiment of the package of the present disclosure, wherein a straw aperture is formed in the header, the header is provided with a tear-away compartment with printed material, and wherein the side of the carton includes a reinforcing member.

FIG. 22 illustrates an embodiment of package 10 wherein a straw-aperture 68 in header 18, typically initially being sealed but providing an easy opening for the consumer. FIG. 22 additionally illustrates the structure of the removable header portion 29 illustrated in FIG. 27H. Further illustrated in FIG. 22 is the attachment of a rigid support member 153 to the side of second gusseted side 36, as well as the header structure illustrated and described with respect to FIG. 27H. Additionally illustrated on FIG. 22 is printing on the header and printing on the carton.

Figure 23:
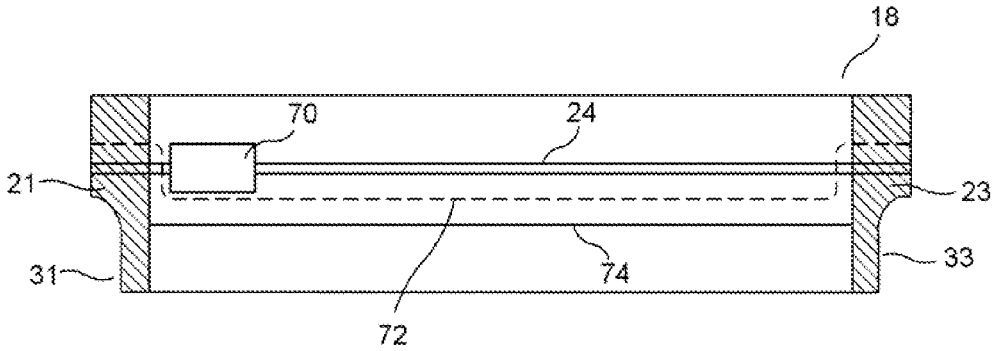
FIG. 23 is a plan view of a header with a slider zipper and a tear-away portion.

FIG. 23 illustrates an embodiment of header 18 wherein reclosure 24 is implemented as a flanged zipper with a slider 70. Additionally, the walls of header 18 include a tear line 72 (typically implemented as a line of weakness, such as perforations, laser scored lines, tear beads, tear notches, linear tear films, or similar structures, and may be configured as multiple lines) which is above the reclosure 24 in the first and second cross seals 21, 23, descending to the area between the top of reclosure 24 and the seal lines 74 joining the zipper flanges and the walls of header 18. Slider 70 operates in the conventional way, opening the zipper when moved in a first direction and closing the zipper when moved in a second direction, opposite to the first direction.

Figure 24:
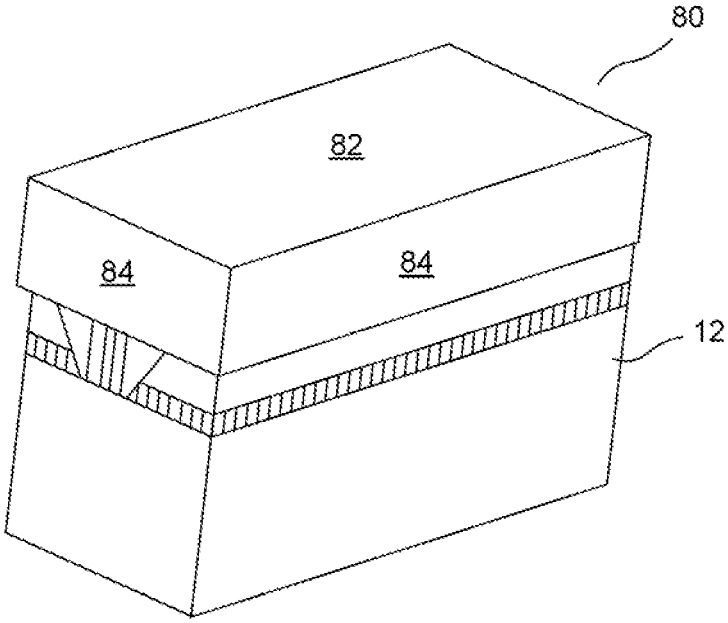
FIG. 24 illustrates an embodiment of the package of the present disclosure with a cap placed over the top of the package.
Figure 25:
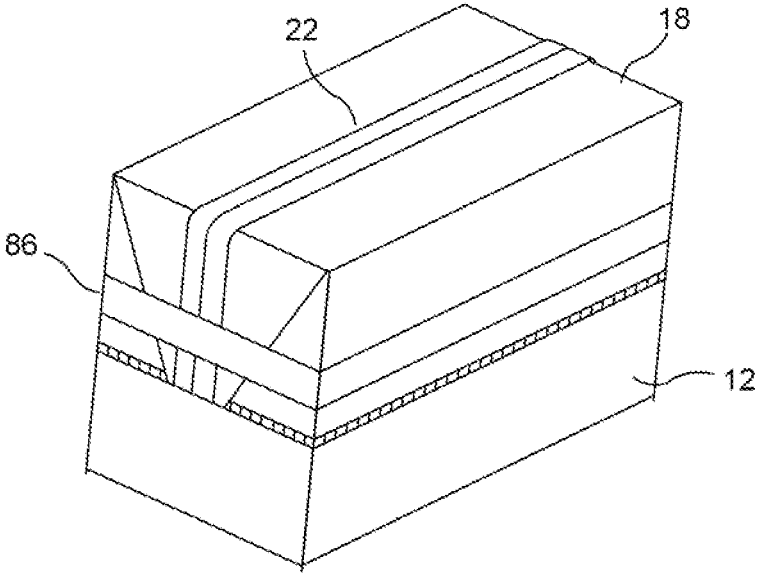
FIG. 25 illustrates an embodiment of the package of the present disclosure with a reinforcing band placed around the package.

FIG. 24 illustrates an embodiment wherein header 18 is held in place by a cap 80. Cap 80 includes rectangular top 82 with side walls 84 extending downwardly therefrom. The rectangular shape of cap 80 aids not only in strengthening or reinforcing the package 10, but also helps the package 18 retain a rectangular cross section. Similarly, FIG. 25 illustrates an embodiment of package 10 with band 86 holding down the header 18. As previously described with respect to FIG. 22, the gusseted sides 35 or 36 may be provided with rigid support member 153. Top 82 and band 86 may be breakably attached to semi-rigid container 12, thereby providing tamper evidence, if removed.

Figure 26:
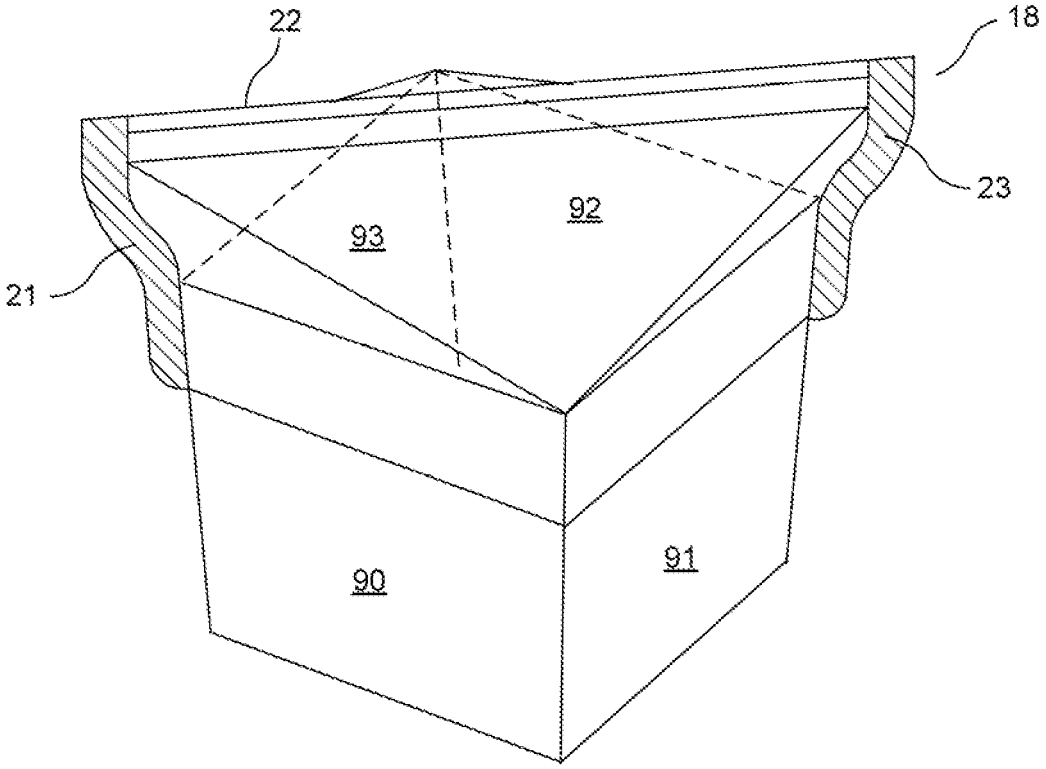
FIG. 26 illustrates an embodiment of the package of the present disclosure, which is free of gussets and includes a diagonally oriented zipper spanning opposing corners of the container portion.

FIG. 26 illustrates an embodiment of package 10 with a rectangular semi-rigid container 12 which has four sides 90, 91, 92, 93 thereby forming a square or rectangular shape which is free of gussets. The header 18 is glued, sealed or otherwise attached to flattened semi-rigid container 12 by methods previously described so that cross-seal 21 is aligned with the corner or fold formed between sides 90, 93 and cross-seal 23 is aligned with the corner or fold formed between sides 91, 92 (formed oppositely from the corner formed by sides 90, 93). This configuration allows the semi-rigid container 12, with the header 18 attached, to lie flat prior to filling (that is, sidewalls 90 and 93 are pressed or folded flat against each other and sidewalls 91, 92 are pressed or folded flat against each other), similar to the previously described embodiments, however without requiring gussets. In the open configuration, as shown in FIG. 26, the zipper 24 extends diagonally across the open top of the semi-rigid container. Similar configurations could be achieved with packages with an even number of sides, greater than four.

Thus the several aforementioned objects and advantages are most effectively attained. Although preferred embodiments of the invention have been disclosed and described in detail herein, it should be understood that this invention is in no sense limited thereby and its scope is to be determined by that of the appended claims.

What is claimed is:

1. A method for forming a series of packages including a rigid or semi-rigid container portion and a polymeric header, including:

providing a source of a series of flat, folded rigid or semi-rigid container portions;

providing a source of continuous web material as a single sheet of web material;

providing a source of continuous reclosure material as a length of zipper material with first and second interlockable profiles interlocked with each other;

folding the single sheet of web material thereby forming a web material fold;

attaching the length of zipper material to the single sheet of web material;

attaching the continuous web material, including the continuous reclosure material attached thereto within the web material fold, to the top of the series of rigid or semi-rigid container portions thereby forming a header, the sequential rigid or semi-rigid container portions being separated by an interval; and creating cross-seals in the web material between successive packages.

2. The method of claim 1 wherein the zipper material is chosen from the group consisting of a flanged zipper free of sliders, a flanged zipper with a slider, a flanged zipper with opening lips, a flanged tamper-resistant zipper, a tamper-evident zipper, a string zipper, a double zipper, a multiple track zipper, a zipper with a tear line, a zipper with flanges connected above the locking elements, a zipper with flanges connected below the locking elements, a leak-resistant zipper, a zipper with a peel seal, a hinged zipper, a zipper with spot seals, a zipper with eyemarks, a partly sealed zipper, a zipper with shape-retaining characteristics, a pinch grip pull zipper, zipper tape, a perforated cap zipper tape, a zipper with a weakened line of resistance, a zipper with a wedge, a zipper with a stabilizing post, a zipper with guide ribs, a zipper with a compression post, and a laminated zipper tape with a tear bead.

3. The method of claim 1 wherein the steps of providing a source of continuous web material, providing a source of continuous reclosure material, and attaching the length of zipper material to the single sheet of web material are performed by a step of providing the continuous web material with the zipper material attached thereto.

4. The method of claim 1 wherein the step of folding is performed prior to the step of attaching the length of zipper material to the single sheet of web.

5. The method of claim 4 further including the step of inserting the length of zipper material into a fold formed by the step of folding.

6. The method of claim 1 wherein the step of attaching the length of zipper material to the single sheet of web material includes a first step of attaching the first profile to the single sheet of web material and a second step of attaching the second profile to the single sheet of web material, and wherein the first step of attaching the first profile to the single sheet of web material is performed prior to the step of folding, and the step of folding is performed prior to the second step of attaching the second profile to the single sheet of web.

7. The method of claim 2 wherein the step of providing a source of flat, folded rigid or semi-rigid container portions includes the step of providing a stack of flat, folded rigid or semi-rigid container portions and feeding the rigid or semi-rigid container portions by a first conveyor belt into a nip formed between upper and lower pull conveyor belts.

8. The method of claim 1 further including conveying the rigid or semi-rigid container portions by a lugged chain.

9. The method of claim 1 wherein the step of providing a source of continuous web material includes the step of providing a source of continuous web material including periodic marks, and wherein the method further includes the steps of reading the marks and controlling the source of rigid or semi-rigid container portions or the source of continuous web material in response thereto.

10. The method of claim 1 wherein the step of creating cross-seals simultaneously forms cross-seals in a plurality of successive inter-package gaps.

11. The method of claim 10 wherein the step of creating cross-seals is performed ultrasonically.

12. The method of claim 10 wherein the step of creating cross-seals is performed thermally.

13. The method of claim 10 wherein the step of creating cross-seals is performed by a cross-sealer which travels in a machine direction during operation.

14. The method of claim 1 further including the step of cutting the cross-seals between adjacent packages.

15. The method of claim 1 further including the step of perforating the cross-seals between adjacent packages.

16. The method of claim 1 further including steps of unfolding the web material, positioning a container portion over a first part of the unfolded web material and thereafter folding a second part of the web material over the container portion are performed prior to the step of attaching the web material to the container portion.

17. The method of claim 1, wherein portions of the length of reclosure material extend beyond the edges of the container portions.

18. The method of claim 1, wherein lower edges of the web material overlap edges of the folded container portions.

19. The method of claim 1, wherein lower edges of the web material are attached to outside edges of the folded container portions.

20. The method of claim 1, wherein lower edges of the web material are attached to the inside of the container portions.

21. The method of claim 20, wherein the step of attaching the web material to the inside of the container portion includes the steps of slitting the folded edges of the flat folded container portion and placing web material within the slit folded edges and thereafter attaching the web material to the slit folded edges.

22. The method of claim 20, further including the steps of providing the flat folded container portions with upwardly facing flaps and placing the web material between the flaps and thereafter attaching the web material to the flaps.

23. The method of claim 1, wherein the step of attaching the continuous web material to the top of the series of rigid or semi-rigid container portion is performed by heat sealing.

24. The method of claim 1, wherein the step of attaching the continuous web material to the top of the series of rigid or semi-rigid container portion is performed by adhesive.

25. The method of claim 1, wherein the length of web material or zipper material includes a peel seal.

26. The method of claim 1, wherein the length of web material or zipper material is provided with periodic eye-marks.

27. The method of claim 1, wherein the length of web material is printed.

28. The method of claim 1, further including the step of providing one or more folds in the length of web material.

29. The method of claim 1 wherein the flat folded container portions include an even number of panels.

30. The method of claim 1, wherein prior to the step of attaching the length of web material, steps of folding the web material, introducing the length of zipper material between the folded web material and attaching the length of zipper material to the folded web material are performed.

31. The method of claim 1 wherein the step of providing a source of continuous web material further includes steps of providing the web material in an open flat configuration at a right angle to a direction of travel of the container portions, redirecting the web material in the direction of travel of the container portions, and folding the web material over the container portions.

32. The method of claim 31 further including the step of placing glue dots on the web material prior to the step of folding the web material over the container portions.

33. The method of claim 1, further including the step of mounting a slider on the zipper material prior to the step of attaching the zipper material to the web material.

34. The method of claim 1, further including the step of mounting a slider to the zipper material after the step of attaching the zipper material to the web material.

35. The method of claim 1 further including the step of forming a chain of packages joined by lengths of web material.

36. The method of claim 11, further including the step of cutting the cross-seals thereby forming several packages.

37. The method of claim 36, further including the step of forming a stack of packages.

38. The method of claim 36, wherein after the step of cutting the cross-seals, the step of unfolding the container portions is performed, thereby forming a storage volume within the container portion, and further forming an open bottom in the container portion.

39. The method of claim 38 further including the steps of filling the container portion through the open bottom and closing the bottom.

40. The method of claim 39 wherein the step of closing the bottom is performed by heat sealing.

41. The method of claim 40 wherein the step of closing the bottom is performed by a band sealer.

42. The method of claim 39 wherein the step of closing the bottom is performed by adhesive.

43. The method of claim 38, further including the step of closing the bottom of the container portion.

44. The method of claim 43 wherein the step of closing the bottom of the container portion is performed with adhesive.

45. The method of claim 43 further including the steps of opening the reclosure, filling the package through the reclosure, closing the reclosure, and sealing the header over the reclosure.

46. The method of claim 43 further including the steps of providing an unsealed opening between the reclosure and the web material, filling the package through the unsealed opening, and thereafter closing the opening.

47. The method of claim 43 further including the steps of providing an unsealed opening between the web material and the container portion, filling the package through the unsealed opening, and thereafter closing the opening.

48. The method of claim 38 further including the step of inserting a mandrel into the container portion thereby maintaining the container portion in an open configuration.

49. The method of claim 39 wherein the resulting package is hermetic.

50. The method of claim 39 wherein after the step of filling the container portion, the step of folding the web material above the container portion onto the container portion, with extended ends of the web material folded onto sides of the container portion, is performed.

51. The method of claim 50, wherein the extended ends are held to sides of the container portion by a releasable element.

52. The method of claim 51 wherein the releasable element is a glue dot.

53. The method of claim 38 further including the step of attaching a reinforcing element to at least one side of the container portion.

54. The method of claim 50 further including the step of placing a cap over a top of the container portion.

55. The method of claim 50 further including the step of placing a band around the container portion, thereby maintaining the folded web material in place.

* * * * *